US008242910B2

(12) United States Patent
Skjellerup et al.

(10) Patent No.: US 8,242,910 B2
(45) Date of Patent: Aug. 14, 2012

(54) SECURITY SYSTEM FOR PREVENTING UNAUTHORIZED REMOVAL OF MERCHANDISE

(76) Inventors: Johan Skjellerup, Boca Raton, FL (US); Eddie L. Stenild, Kastrup (DK)

( * ) Notice: Subject to any disclaimer, the term of this patent is extended or adjusted under 35 U.S.C. 154(b) by 959 days.

(21) Appl. No.: 12/217,613

(22) Filed: Jul. 7, 2008

(65) Prior Publication Data

US 2008/0291029 A1 Nov. 27, 2008

Related U.S. Application Data

(63) Continuation-in-part of application No. 11/805,307, filed on May 23, 2007, now Pat. No. 7,474,216, which is a continuation-in-part of application No. 11/363,436, filed on Feb. 27, 2006, now Pat. No. 7,286,054, which is a continuation-in-part of application No. 11/056,565, filed on Feb. 11, 2005, now Pat. No. 7,382,256, which is a continuation-in-part of application No. 11/008,641, filed on Dec. 9, 2004, now abandoned.

(51) Int. Cl.
*G08B 13/14* (2006.01)

(52) U.S. Cl. ..... 340/572.1; 340/572.3; 340/572.9; 340/572.8; 340/568.1

(58) Field of Classification Search ..... 340/572.1, 340/572.8, 527.9, 568.1, 693.5, 572.3; 235/375, 235/385

See application file for complete search history.

(56) References Cited

U.S. PATENT DOCUMENTS

| | | | |
|---|---|---|---|
| D205,049 | S | 6/1966 | Brady et al. |
| 3,974,581 | A | 8/1976 | Martens et al. |
| 4,299,870 | A | 11/1981 | Humble |
| 4,339,853 | A | 7/1982 | Lipschitz |
| 4,523,356 | A | 6/1985 | Charlot, Jr. |
| 4,527,310 | A | 7/1985 | Vandebult |
| 4,590,461 | A | 5/1986 | Cooper |
| 4,603,453 | A | 8/1986 | Yokoyama |
| 4,651,136 | A | 3/1987 | Anderson et al. |
| 4,670,950 | A | 6/1987 | Wisecup et al. |
| 4,685,234 | A | 8/1987 | Anderson et al. |
| 4,774,503 | A | 9/1988 | Bussard |
| 4,884,833 | A | 12/1989 | Pedersen |
| 4,944,075 | A | 7/1990 | Hogan |
| 4,993,245 | A | 2/1991 | Ott |
| 5,031,287 | A | 7/1991 | Charlot, Jr. et al. |
| 5,054,172 | A | 10/1991 | Hogan et al. |
| 5,077,872 | A | 1/1992 | Guthammar |
| 5,088,165 | A | 2/1992 | Minasy et al. |

(Continued)

FOREIGN PATENT DOCUMENTS

| | | | |
|---|---|---|---|
| EP | 0 404 329 | A1 | 12/1990 |

(Continued)

*Primary Examiner* — Hoi Lau
(74) *Attorney, Agent, or Firm* — Malloy & Malloy, P.L.

(57) ABSTRACT

A security tag assembly and security system associated therewith to prevent the unauthorized removal of merchandise from a given area, such as a retail establishment. The security tag assembly comprises a base and at least one attachment member removably connected in an operative position on the merchandise being protected. A locking assembly including a locking member is structured to restrict detachment of the attachment member and is forcibly disposed out of movement restricting relation to said connector member when the base and the attachment member are separated. A detachment assembly and a data registering processor may include a two-way communication link which facilitates processing of the merchandise data disposed on the security tag assembly, such that the purchasing of the merchandise and the removal of the security tag assembly can be effectively accomplished without jeopardizing the security of the merchandise being sold.

7 Claims, 31 Drawing Sheets

U.S. PATENT DOCUMENTS

| | | | | |
|---|---|---|---|---|
| 5,151,684 | A | | 9/1992 | Johnsen |
| 5,205,024 | A | | 4/1993 | Willard |
| 5,208,580 | A | | 5/1993 | Crossfield |
| D343,134 | S | | 1/1994 | Witzky et al. |
| D343,135 | S | | 1/1994 | Witzky et al. |
| D344,033 | S | | 2/1994 | Davidge |
| 5,347,262 | A | | 9/1994 | Thurmond et al. |
| 5,367,289 | A | | 11/1994 | Baro et al. |
| D354,924 | S | | 1/1995 | Garner et al. |
| 5,426,419 | A | * | 6/1995 | Nguyen et al. ..... 340/572.9 |
| 5,497,639 | A | | 3/1996 | Charlot, Jr. |
| 5,587,703 | A | | 12/1996 | Dumont |
| 5,600,977 | A | | 2/1997 | Piron |
| 5,613,384 | A | | 3/1997 | Weber et al. |
| 5,748,089 | A | | 5/1998 | Sizemore |
| 5,786,762 | A | | 7/1998 | Liu |
| D410,400 | S | | 6/1999 | Skjellerup |
| 5,912,622 | A | | 6/1999 | Endo et al. |
| 5,942,978 | A | | 8/1999 | Shafer |
| 5,942,987 | A | | 8/1999 | Heinrich et al. |
| 5,955,951 | A | | 9/1999 | Wischerop et al. |
| 6,023,951 | A | | 2/2000 | Maurer et al. |
| 6,089,453 | A | | 7/2000 | Kayser et al. |
| 6,281,800 | B1 | | 8/2001 | Sizemore |
| 6,348,865 | B1 | | 2/2002 | Siegel |
| D455,363 | S | | 4/2002 | Fuss |
| 6,535,130 | B2 | | 3/2003 | Nguyen et al. |
| 6,722,166 | B2 | | 4/2004 | Skjellerup |
| 6,724,307 | B1 | | 4/2004 | Siegel |
| 6,752,837 | B2 | | 6/2004 | Karp |
| D494,488 | S | | 8/2004 | Sayegh |
| 6,774,794 | B2 | | 8/2004 | Zimmerman et al. |
| 7,073,236 | B2 | | 7/2006 | Xue et al. |
| 7,075,440 | B2 | | 7/2006 | Fabian et al. |
| 7,148,805 | B2 | | 12/2006 | Hogan |
| 7,183,917 | B2 | | 2/2007 | Piccoli et al. |
| 7,286,054 | B2 | | 10/2007 | Skjellerup et al. |
| 7,382,256 | B2 | | 6/2008 | Skjellerup et al. |
| 7,474,216 | B2 | | 1/2009 | Skjellerup et al. |
| 2002/0105424 | A1 | | 8/2002 | Alicot et al. |
| 2003/0067397 | A1 | | 4/2003 | Trimble |
| 2004/0016269 | A1 | | 1/2004 | Skjellerup |
| 2004/0070507 | A1 | | 4/2004 | Campero |
| 2004/0231375 | A1 | | 11/2004 | Skjellerup |
| 2004/0233042 | A1 | | 11/2004 | Piccoli et al. |
| 2005/0218218 | A1 | | 10/2005 | Koster |
| 2006/0017574 | A1 | | 1/2006 | Skjellerup |
| 2006/0125643 | A1 | | 6/2006 | Skjellerup et al. |
| 2006/0139176 | A1 | | 6/2006 | Skjellerup et al. |
| 2006/0208908 | A1 | | 9/2006 | Skjellerup et al. |
| 2007/0273523 | A1 | | 11/2007 | Skjellerup et al. |
| 2009/0128341 | A1 | | 5/2009 | Skjellerup et al. |

FOREIGN PATENT DOCUMENTS

| | | | |
|---|---|---|---|
| EP | 0 594 324 | A2 | 4/1994 |
| EP | 1 391 574 | A2 | 2/2004 |
| JP | 2006-249364 | A | 9/2006 |

* cited by examiner

SECURITY SYSTEM FOR PREVENTING UNAUTHORIZED REMOVAL OF MERCHANDISE

CLAIM OF PRIORITY

The present application is a continuation-in-part application of a previously filed application having Ser. No. 11/805,307, filed on May 23, 2007, which matured into U.S. Pat. No. 7,474,216 on Jan. 6, 2009, which is a continuation-in-part of U.S. patent application having Ser. No. 11/363,436, filed on Feb. 27, 2006, now U.S. Pat. No. 7,286,054, which is a continuation-in-part of U.S. patent application having Ser. No. 11/056,565, filed on Feb. 11, 2005, now U.S. Pat. No. 7,382,256, which is a continuation-in-part application of a previously filed, now abandoned application having Ser. No. 11/008,641, filed on Dec. 9, 2004, all of which are incorporated herein in their entirety by reference.

BACKGROUND OF THE INVENTION

1. Field of the Invention

This invention relates to a security system incorporating a security tag assembly comprising a base and an attachment member removably securable to various types of merchandise. The security system further comprises a detachment assembly structured to disconnect the base and attachment member and thereby remove the security tag assembly from the merchandise.

2. Description of the Related Art

Security or anti-theft tags are extensively used in the retail merchandising industry as well as numerous other areas of commerce. In typical fashion, such devices are attached to various types of merchandise in such a manner that that they are clearly obvious by one examining the merchandise. Common knowledge of the use and operation of such devices is believed to prevent or at least restrict the theft or other unauthorized removal of merchandise from the retail outlet or other area being monitored. More specifically, it is believed that such security tag devices serve as a deterrent to unauthorized removal in that a potential thief will recognize that the merchandise will be "stained" or otherwise marked, thereby rendering the merchandise useless, upon forced removal of the security tag. Alternatively the tag may be structured to activate an alarm system as the merchandise, incorporating the tag thereon, passes through a monitoring station typically located at the exits to the retail establishment.

Due to the popularity of security or anti-theft devices of the type described above, numerous attempts have been made to design and structure a device which not only serves as a deterrent against theft, but which includes structural features intended to overcome any attempt to defeat the device which may be applied by an experienced thief. In addition, the structure of such security devices should be such as to be easily secured to and removed from different types of articles such that a device of substantially standard structure can be used to monitor and protect various types of merchandise.

As set forth above known security or anti-theft tags are intended to provide some indication which either renders the merchandise useless or alternatively signals an attempted unauthorized removal.

While popular, it is recognized that a significant number of the anti-theft tags currently being utilized include problems or disadvantages which render them less than totally efficient. More specifically, wide spread knowledge of the structural features of such security tags allows unauthorized personnel to develop techniques which are specifically designed to remove the tag from the merchandise in a manner which defeats the aforementioned indicator structures. Therefore it is not uncommon for a skilled or experienced thief to develop tools or techniques to remove the merchandise from the area being monitored without damage to the stolen article or activation of an alarm or monitoring system.

Accordingly there is a recognized need in the security industry for a security system incorporating an anti-theft device preferably in the form of a relatively small security tag assembly which efficiently connects to various types of merchandise and which is specifically structured to overcome known techniques to remove or otherwise defeat such devices. Moreover, such protective structural features should be compatible with an efficient tag construction and configuration. Therefore, a security tag manufacture or provider to can effectively "customize" a proposed indicator assembly to include various "theft indicating" devices, electronic signaling devices or a combination thereof, while not requiring a restructuring or redesign of the entire tag assembly or the remaining, basic operable components associated therewith.

SUMMARY OF THE INVENTION

The present invention is directed to a security system comprising a security tag assembly structured to be connected to different types of merchandise in an operative position. The structural and operative features of the various embodiments of the present invention allow authorized detachment of the security tag assembly from the merchandise in a quick and easy manner.

The various embodiments of the security tag assembly include at least one base and at least one attachment member connectable together in the operative position. However, as practically applied, a plurality of bases and attachment members are utilized, such as when protecting and/or monitoring a plurality of products and merchandise.

The aforementioned operative position may be more specifically defined as the placement of a connector member, fixedly secured to the base and extending outwardly therefrom into interconnecting relation with one of the plurality of attachment members. As such, the connector member preferably includes an elongated pin secured to and extending outwardly from the base. Further, the connector pin may include a sharpened or pointed outermost end to facilitate penetration and/or connection to the merchandise being protected as well as passage into the interior of the corresponding attachment member. Further, when in the operative position the merchandise, depending upon its physical characteristics, will normally be clamped between exterior surfaces of the attachment member and the base.

In order to maintain a secure connection between the base and the attachment member in the operative position and in clamping engagement with the merchandise being protected, each of the plurality of attachment members includes a locking assembly. The locking assembly is disposed on or within the attachment member in receiving relation to the connector member when the attachment member is being disposed in the operative position relative to its interconnection with the base.

In addition, the security system of at least one embodiment comprises a detachment assembly and a data registering processor cooperatively structured to establish two-way communication therebetween. Such communication link may be by means of a hard wire connection or alternatively by means of a wireless communication facility which accomplishes the aforementioned two way communication within certain range or distance parameters.

The cooperative communication and structuring of the detachment assembly and the data registering processor facilitates not only the secure protection of various types of products or merchandise but also accomplishes a more efficient performance of the purchase and "check-out" procedures of the merchandize by authorized personnel. As such, the data registering processor can include, but not be limited to, performance parameters which are more commonly associated with a cash register type facility. Moreover, the data registering processor receives communication from the detachment assembly which is representative of the merchandise data appearing on the security tag assembly. When received, the data registering processor serves to process the merchandise data including, but not limited to, the displaying of pertinent information required for purchase and check-out including price, item description, quantity, and/or other pertinent data associated with the product or merchandise being purchased.

Operation of the detachment assembly of includes a plurality of operative components associated therewith. Such operative components include a position sensor indicative of orienting the security tag assembly in operative association with the detachment assembly to accomplish detachment thereof out of its operative position relative to the merchandise being protected. The detachment assembly further includes a detachment structure and a holding assembly which cooperate to stabilize the security tag assembly during detachment of the base and attachment member. As a result, the security tag assembly is removed from its operative position on the merchandise being protected.

The disposable nature of each of the attachment members is further emphasized by structuring the locking assembly so as to be deformed or destroyed, at least in terms of its originally intended operation, upon a forced removal of the connector pin from its interior interconnection with an attachment assembly. Therefore, the locking assembly of the plurality of attachment members can be described as being "destructively detached" out of movement restricting engagement with the connector pin upon a forced movement or travel of the connector pin out of the attachment member, such as when the attachment member and base are forcibly separated.

More specifically, a preferred detachment assembly comprises a drive shaft having an at least partially hollow, interior configuration disposed adjacent a free, open end of the drive shaft. Also, the hollow interior end portion of the attachment member is dimensioned and configured to assume a covering, enclosing relation to at least a portion of the free or pointed end of the connector member. As the drive shaft enters the attachment member, a portion of the attachment member may be destructively removed such that the distal or open free end of the drive shaft proceeds into a forced engagement with the locking member. The locking member is formed of a substantially flexible and deformable material such as a plastic, metal, etc. Upon forced engagement with the drive shaft, the locking member is deformed and/or deflected into a second position such that the periphery of the aperture within the first portion of the locking member is forced out of movement restricting engagement with the exterior surface of the connector member.

As will be described in greater detailed hereinafter, the aforementioned second position of the locking member may be defined by a somewhat "flattened" or sufficiently transverse orientation, as versus a skewed, angular configuration, relative to the longitudinal access of the connector member. Because of the forced deformation of the locking member into the second position, the attachment member may be rendered useless and a new or additional attachment member may then be repositioned in the aforementioned operative position and reused with the same base. As will also be more fully described, the drive shaft further includes a solid or filled interior portion disposed and configured to engage the pointed end of the connector member and force it outwardly from the attachment member. Separation of the connector member and the attachment member will result.

Therefore, the various preferred embodiments of the security system and security tag assembly of the present invention overcomes many of the problems and disadvantages associated with conventional or previously known security systems and devices and embodies simple and efficient structure, which facilitates the attachment, removal and efficient practice of security as related to the unauthorized removal of the protected merchandise from a given area.

These and other objects, features and advantages of the present invention will become clear when the drawings as well as the detailed description are taken into consideration.

BRIEF DESCRIPTION OF THE DRAWINGS

For a more complete understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
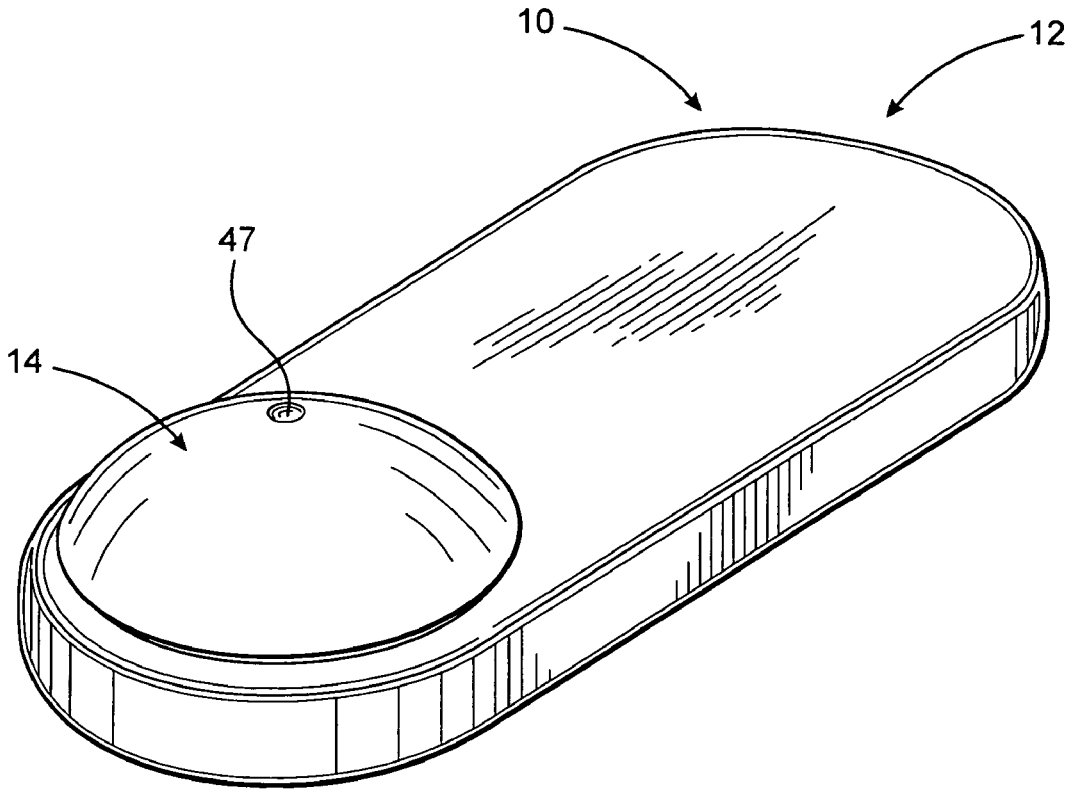
FIG. 1 perspective view of one preferred embodiment of the security tag assembly of the present invention.
Figure 3:
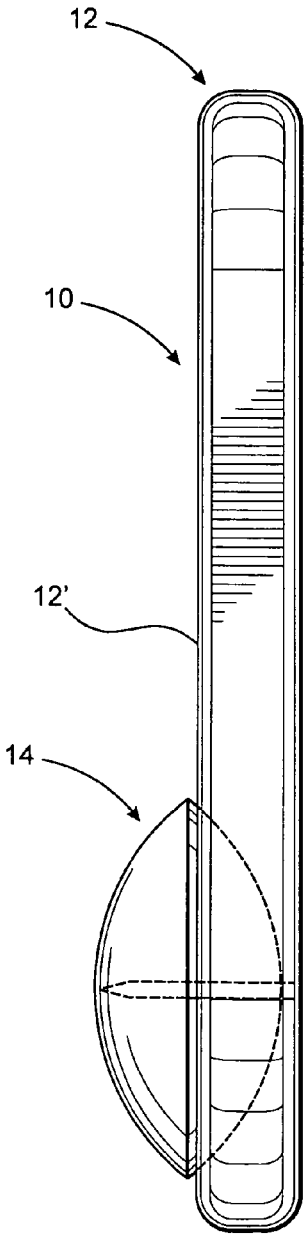
FIG. 3 is a left side view of the embodiment of FIG. 2.
Figure 2:
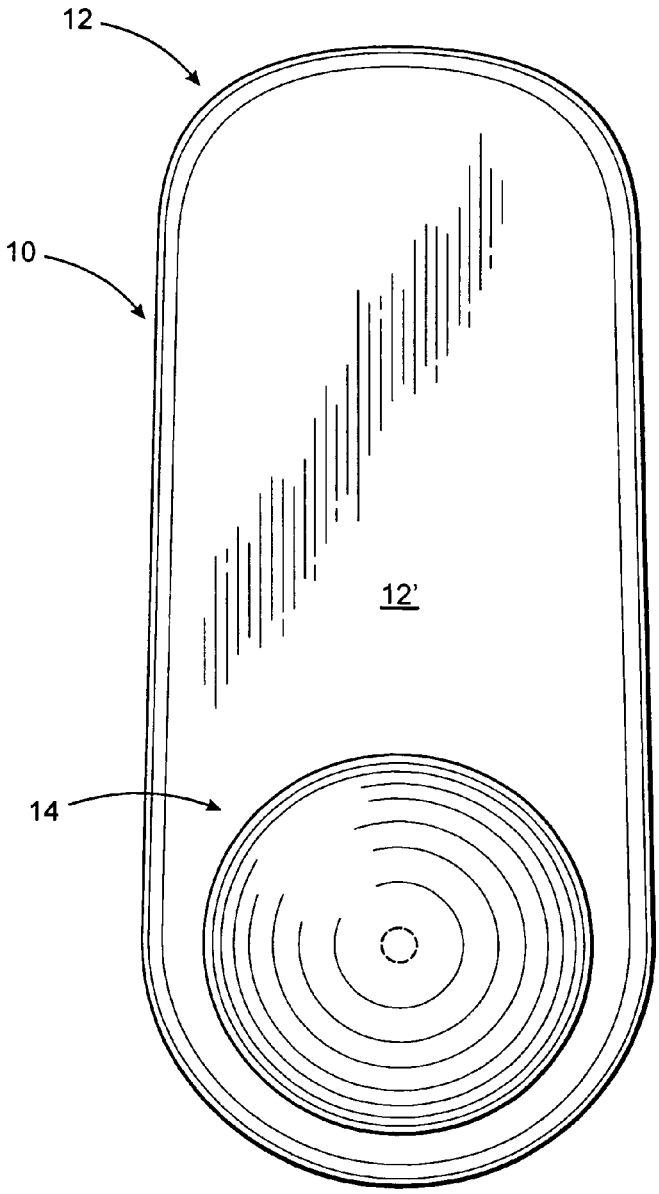
FIG. 2 is a top view of the embodiment of FIG. 1.
Figure 4:
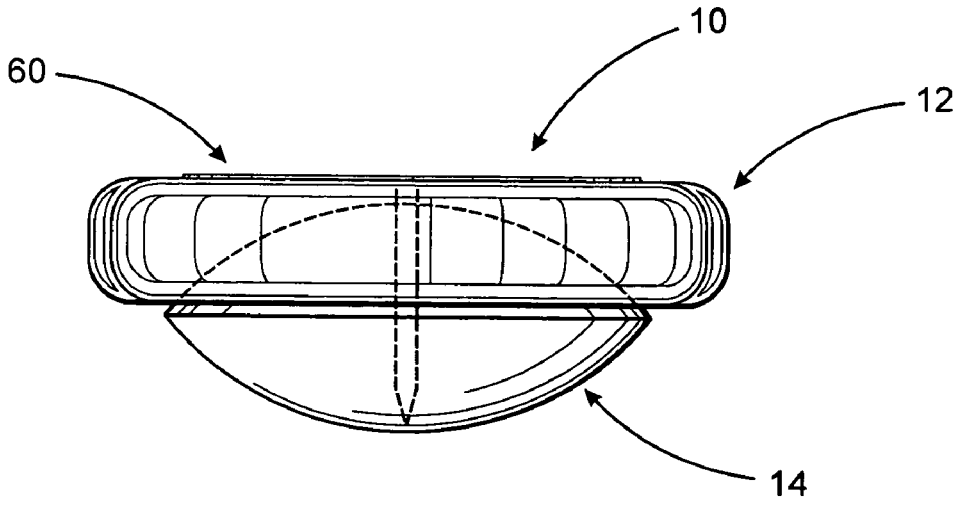
FIG. 4 is a bottom view of the embodiment of FIG. 2.
Figure 6:
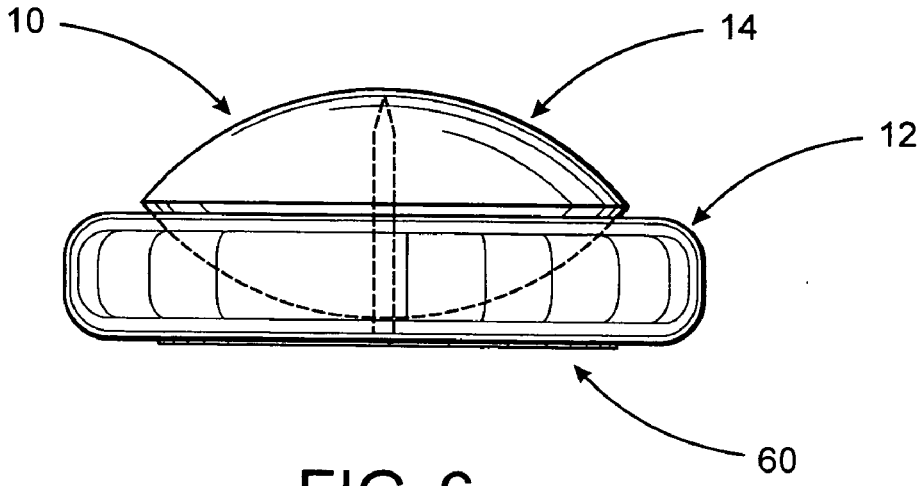
FIG. 6 is a top view of the embodiment of FIG. 2.

As shown in the accompanying drawings, the present invention is directed towards a security tag assembly generally indicated as 10 and comprising at least one base 12 and at least one attachment member 14. However, a practical application of the present invention would typically involve a plurality of bases 12 and a plurality of attachment members 14, such as when a plurality of different products were being protected and/or monitored. Moreover, the security tag assembly 10 is of the type structured to be removably secured to various types of merchandise 18 so as to prevent unauthorized removal of the merchandise 18 from a given area or location. Typical applications for the security tag assembly 10 of the present invention include the interconnecting of one base 12 and any one of a plurality of attachment members 14 to merchandise 18 being protected. As such, removal of the security tag assembly 10 from its operative position can be quickly and easily accomplished by authorized personnel utilizing approved techniques and/or hardware. To the contrary, separation of the base 12 and the attachment member 14 from the operative position and the protected merchandise is extremely difficult when attempted by unauthorized personnel.

Further, at least one preferred embodiment of the present invention comprises each of the plurality of attachment members 14 being structured to be disposable after use, subsequent to being removed from a corresponding base 12 and the merchandise being protected. In contrast, the one or more bases 12 of the security tag assembly 10 of the present invention include various structural and operative features which enable their repeated use. Such features include, but are not limited to, an indicator assembly and a connector member which allow any one of the bases 12 to be connected to any one of the "unused" attachment members 14, as will be described in greater detail hereinafter.

More specific structural details of the various preferred embodiments of the present invention include the base 12 having a generally elongated or other appropriate configuration. In addition, maintenance of the merchandise 18 in a clamped orientation between the base 12 and the attachment member 14 is further facilitated by a seat 20 disposed on the base. The seat 20 is preferably configured to correspond to the outer surface configuration 14' of the attachment member which is disposed in a substantially seated or aligned received relation within the seat 20. The structures of the preferred embodiments represented in the various figures include the seat 20 having a substantially concave configuration which corresponds to the substantially convex configuration 14' of the attachment member 14. Accordingly, when the base 12 and attachment member 14 are in the aforementioned and preferred operative position, the merchandise 18, depending upon its physical characteristics may be effectively clamped "within" the seat 20 between the base 12 and the outer surface portion 14' of the attachment member 14.

In order to maintain a secure interconnection between the base 12 and the one or more attachment members 14, the base 12 is provided with a connector member generally indicated as 22 comprising an elongated connector pin or like structure 24. The innermost end 26 of the pin is secured to the base 12 preferably, but not necessarily, in cooperation with the seat 20. Moreover, the length of the connector pin 24 is sufficient to extend outwardly from the seat 20 as well as a remainder of the adjacent exterior surface 12' of the base 12 so as to engage and be properly connected to the attachment member 14.

Figure 9A:
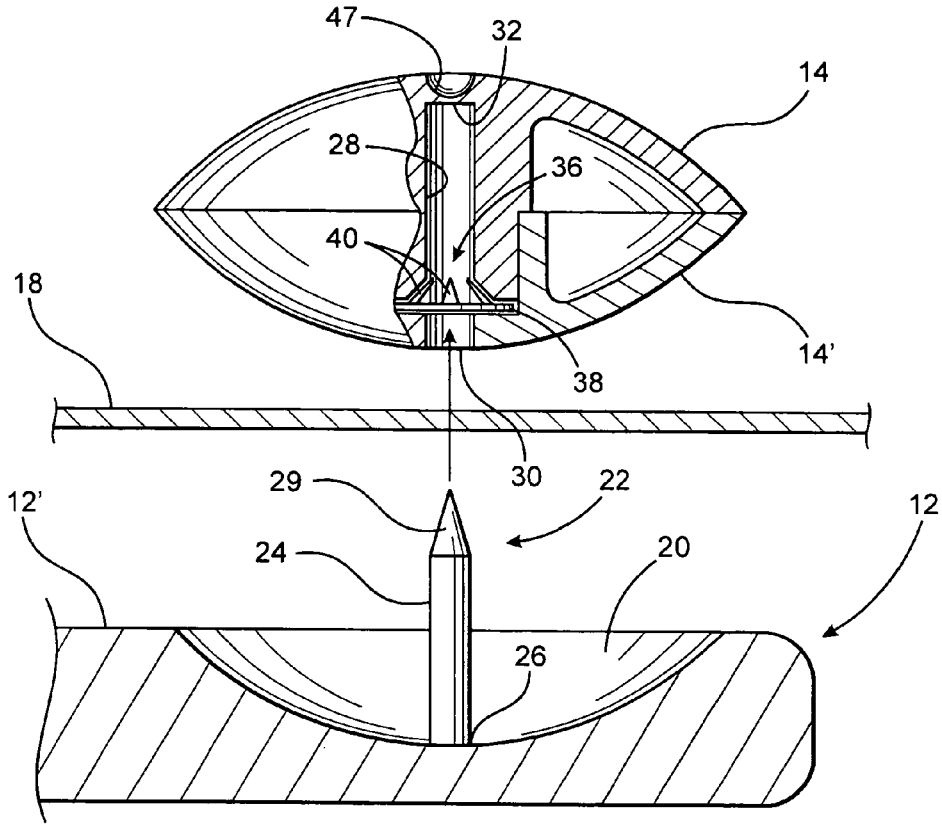
FIG. 9A is an exploded view in partial cutaway and section showing the relative positions of the various operative components for the embodiments of FIGS. 1 through 8 in an unassembled orientation.
Figure 9B:
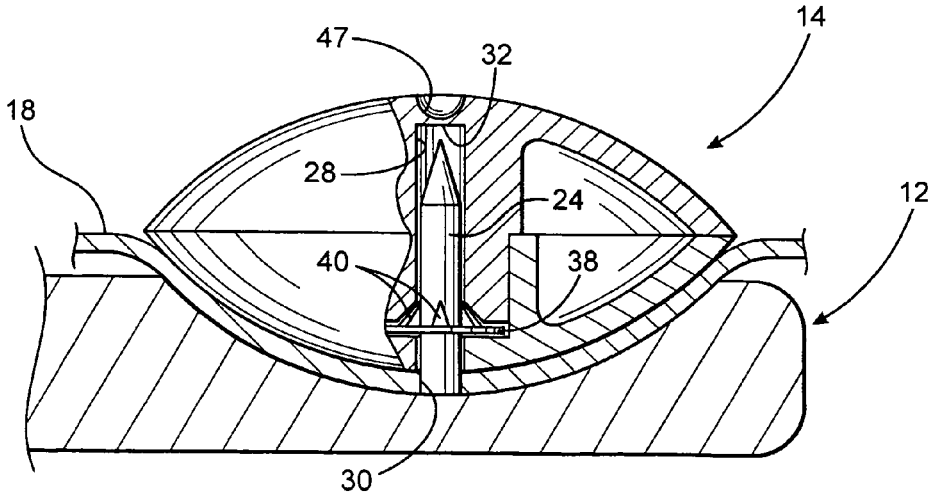
FIG. 9B is a sectional view in partial cutaway of the embodiment of FIG. 9A in an assembled orientation.
Figure 9C:
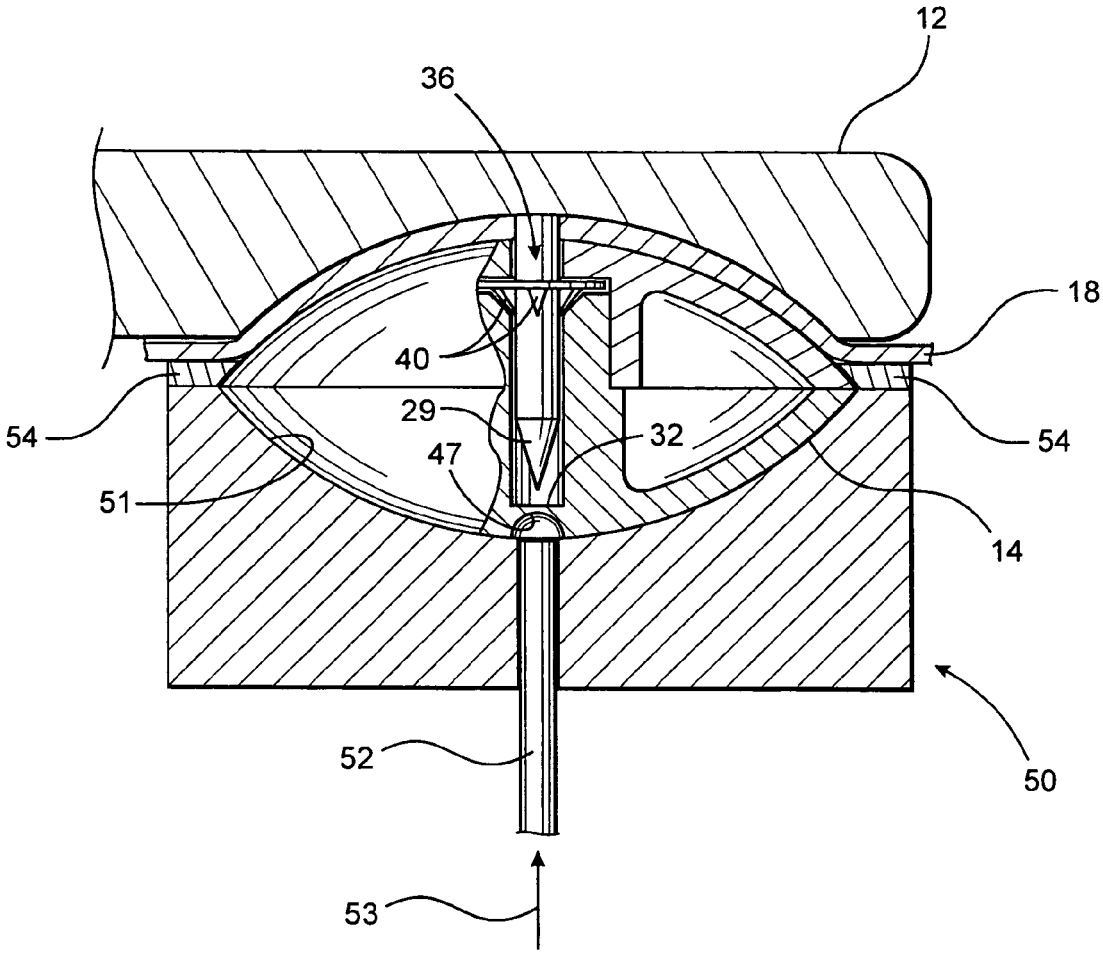
FIG. 9C is a sectional view in partial cutaway representing the separation of the operative components of the preferred embodiment of the present invention from that shown in FIG. 9B.

Cooperative structuring of each of the plurality of attachment members 14 includes an elongated passage or channel 28 disposed on the interior of the one or more attachment members 14. Moreover, the channel 28 has a proximal end 30, which is preferably open, as well as a distal end 32. Each of the proximal and distal ends, 30 and 32 respectively, are disposed contiguous with or immediately adjacent to opposed exterior surface portions of the one or more attachment members 14 as clearly demonstrated in FIGS. 9A through 9C. Therefore, the channel 28 extends substantially entirely along a transverse dimension of the attachment member, wherein such transverse dimension is at least partially defined by the location of the oppositely disposed proximal and distal ends 30 and 32, respectively, of the channel 28. The securing of the attachment member 14 in the preferred, operative position comprises penetration of the merchandise 18 by the connector pin 24 and continued travel of the connector pin 24 through the open proximal end 30 and into the interior of the channel 28 and along a substantial portion of the length thereof. Penetration of the merchandise 18 by the connector pin 24 as well as its passage into the channel 28 may further be facilitated by a pointed or other appropriately shaped tip 29, as demonstrated.

Additional structural features of the various preferred embodiments of the present invention include the provision of a locking assembly generally indicated as 36. The locking assembly 36 is disposed on or preferably within the interior of the attachment member 14 and/or at least in communication with the channel 28 and open end 30 so as to be disposed in receiving relation to the connector pin 24. Therefore, as the connector pin 24 is disposed within the channel 28, it will pass through the open proximal end 30 and be received by the locking assembly 36 as the pin 24 passes there through. One preferred embodiment of the locking assembly 36 comprises a ring 38 disposable in surrounding, concentric relation to the connector pin 24 when it is positioned within the interior of the channel 28 as clearly demonstrated in FIGS. 9B and 9C. In addition, the locking assembly 36 includes a plurality of spaced apart fingers 40 normally disposed in an outwardly angular orientation. As such outer portions of the plurality of fingers 40 movably engage the connector pin 24 when it is disposed within the channel 28. Further, the structure, configuration, disposition and outwardly angular orientation of each of the plurality of fingers 40 is such as to allow inward travel of the connector pin 20 as it passes into the interior of the attachment member 14 along the channel 28. However, the structure of the plurality of fingers 40 is such as to restrict movement of the connector member 24 in the opposite direction or out of the channel 28, such as when the separation of the attachment member 14 and the base 12 is attempted. The locking assembly 36 can therefore be further described as being disposed and structured to movably engage the connector pin 24 such that it facilitates movement or passage thereof inwardly into the interior of the attachment member 14 along the channel 28. In contrast, the structure and orientation of the plurality of fingers 40 is such as to restrict movement of the connector pin 24 in the opposite direction, out of the channel 28, such as when an attempt to disconnect the base 12 and the attachment member 14 from the intended operative position occurs.

Figure 15:
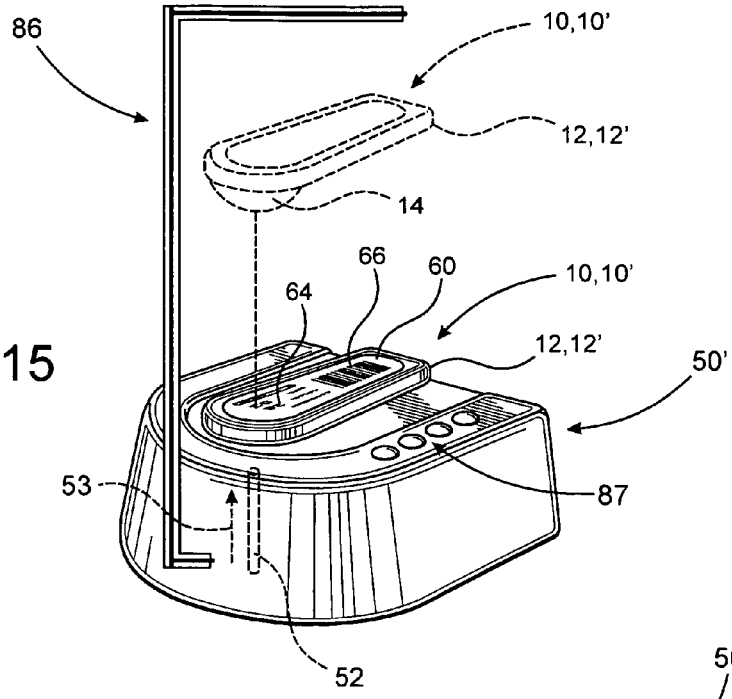
FIG. 15 is a perspective view in schematic form and partial phantom disclosing a preferred embodiment of a security system of the present invention including a structurally modified detachment assembly from that represented in FIG. 10.
Figure 16:
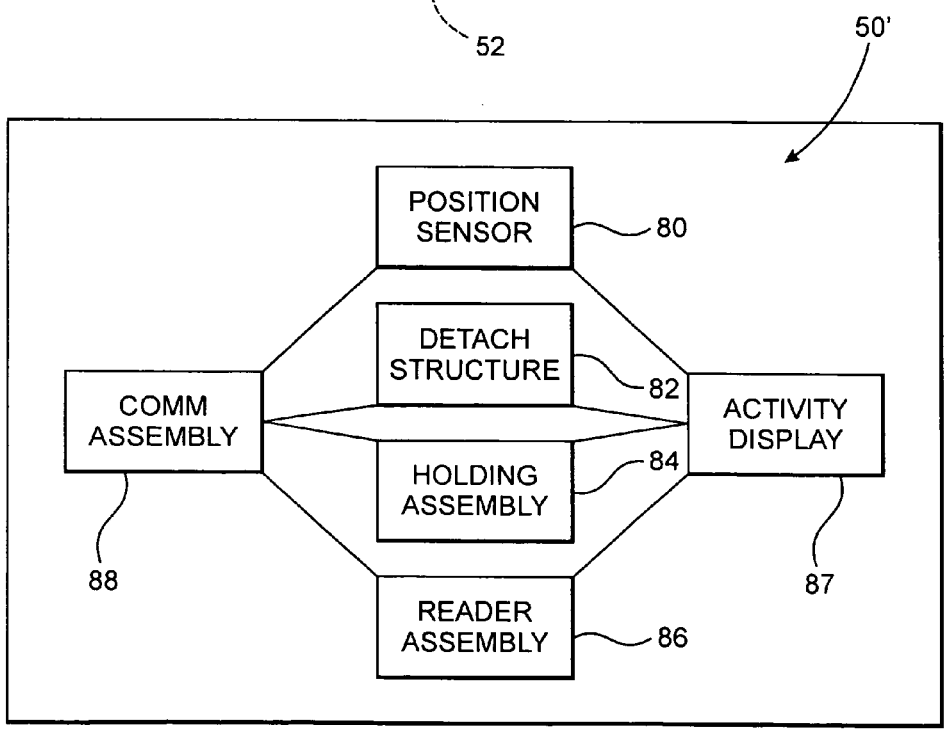
FIG. 16 is a schematic representation in block diagram form of the various operative components of the detachment assembly of the embodiment of FIG. 15.
Figure 17:
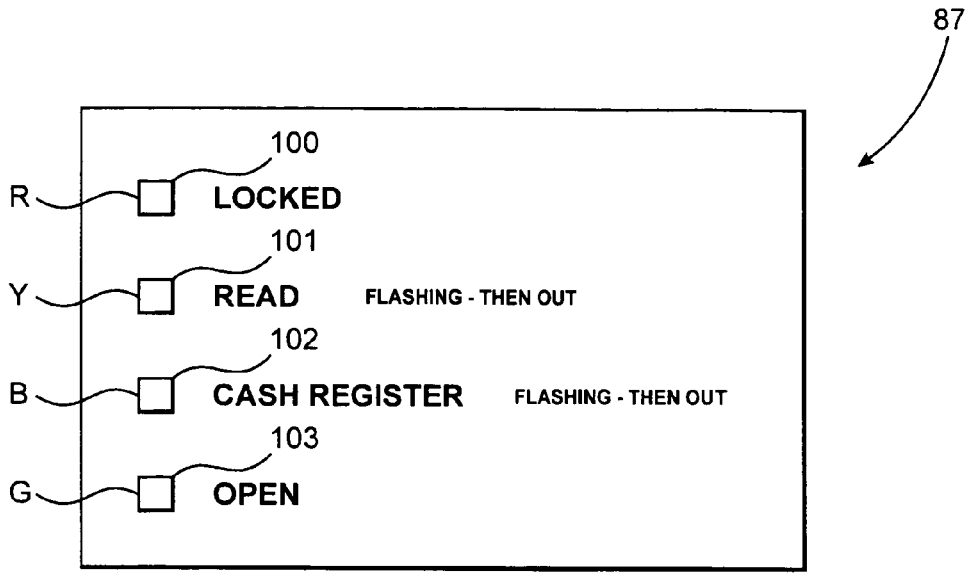
FIG. 17 is a schematic representation in partial block diagram form disclosing details of an activity display assembly associated with the detachment assembly of the embodiment of FIGS. 15 and 16.
Figure 18:
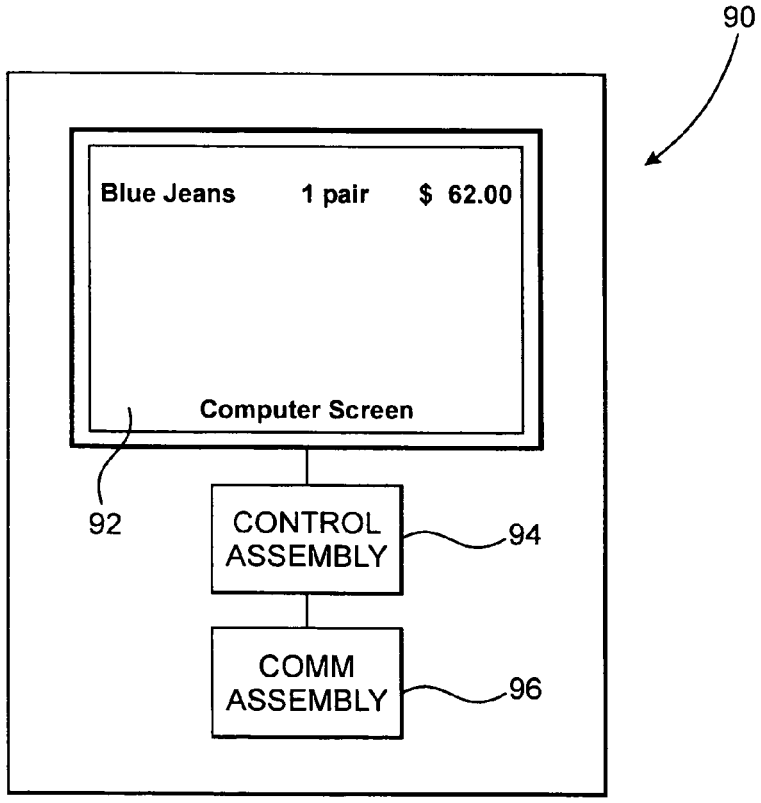
FIG. 18 is a schematic representation of a data registering processor operatively associated with the security system which incorporates the detachment assembly of the embodiment of FIGS. 15 through 17.

As set forth above, one operative feature of the various preferred embodiments of the present invention includes the ability to easily and quickly remove the security tag assembly 10 from the merchandise 18 utilizing authorized personnel, techniques and/or hardware. To the contrary, unauthorized separation of the base 12 and the associated attachment member 14 is rendered extremely difficult when the proper procedures and/or hardware are not utilized. With primary reference to FIGS. 9C, 9D and 10, separation of the base 12 and the attachment member 14 from their intended operative position in clamping engagement with the merchandise 18 can be easily accomplished utilizing an approved or authorized detachment assembly, generally indicated as 50. The detachment assembly 50 is intended to be only representative of a variety of different devices and/or hardware which could be applied to the security tag assembly 10 and structured to separate the base 12 from the attachment member 14 and detach the merchandise 18 therefrom without causing damage to the base 12 or merchandise 18. Another preferred embodiment of the detachment assembly 50' is schematically represented in FIGS. 15 and 16, and will be discussed in greater detail hereinafter. Therefore, the detachment assembly 50, as represented in FIG. 10 is not to be considered in a limiting sense since a variety of other structures can be utilized to accomplish authorized separation of the various preferred embodiments of the security tag assembly 10 out of the operative position of FIG. 9B.

Figure 9D:
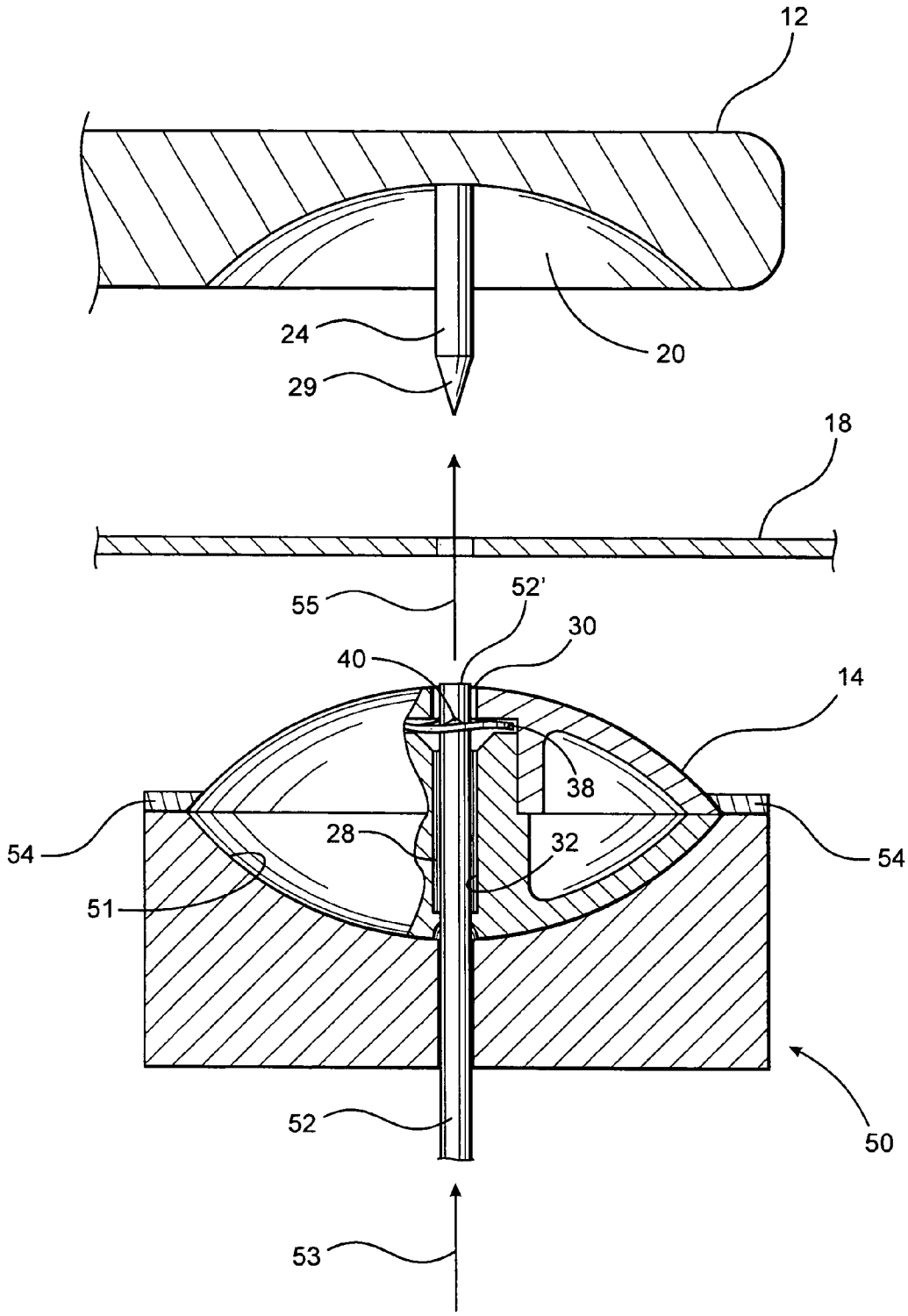
FIG. 9D is an exploded view in cross section and partial cutaway further representing the authorized operation of separating the various components from the position shown in the embodiment of FIG. 9B.
Figure 10:
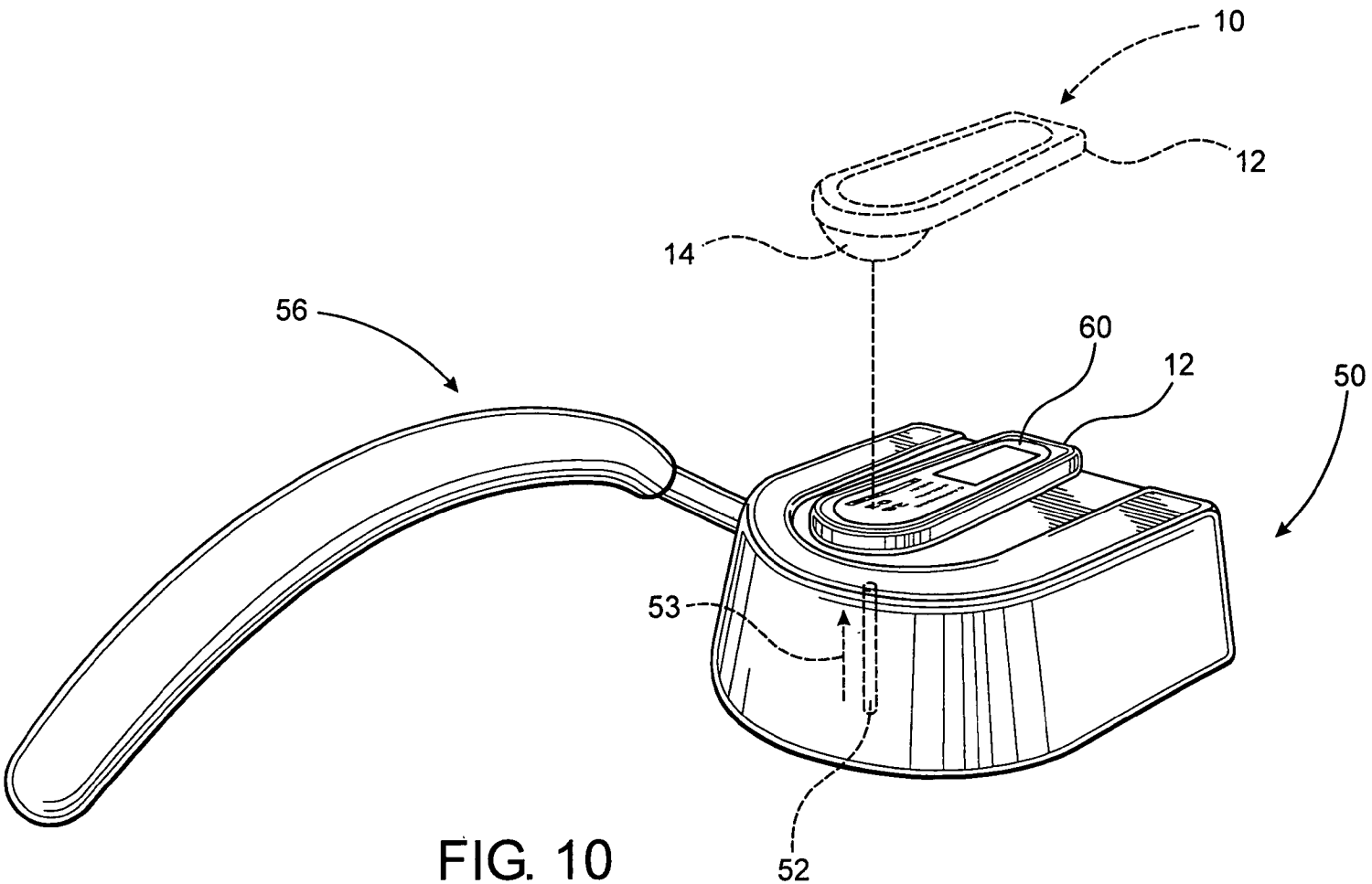
FIG. 10 is a perspective view in exploded form representing a detachment assembly for separating the operative components of the preferred embodiment of the present invention in accord with FIGS. 9C and 9D.

Accordingly, the detachment assembly 50 includes a cavity or like structure 51 (see FIGS. 9C and 9D) for receipt of an attachment member 14 therein when the tag assembly 10 is mounted on the detachment assembly 50 in the orientation disclosed in FIG. 10. In addition, the detachment assembly 50 comprises a drive shaft 52 and a holding or stabilizing structure 54. As also represented, an actuating handle or like structure generally indicated as 56 is connected by appropriate mechanical linkage to the drive shaft 52. A manipulation of the handle assembly 56 causes a positioning of the stabilizing structure 54 into engagement with corresponding portions of the attachment member 14 and a forced movement of the drive shaft 52 into the interior of the attachment member 14, in accordance with directional arrow 53.

The force of the drive shaft 52 will cause a rupture, displacement, detachment and/or otherwise destructive removal of a cover member or portion 47 which overlies and therefore covers or closes the distal end 32 of the channel 28. The specific structuring of the cover member 47 may vary such as being attached in its intended, overlying position to the channel 28 by a weakened or serrated connecting portion. Alternatively, the material from which the attachment member 14, as well as the cover portion 47 is formed may be such as to yield under the linearly directed force exerted thereon by the drive shaft 52 as it travels into the attachment member 14.

Continued travel of the drive shaft 52 into the interior of the channel 28, through the distal end 32, results in an engagement between the extremity 52' of the drive shaft 52 and outer end portion 29 of the connector pin 24. As such, the continued travel and driving force of the drive shaft 52 will force the connector pin 24 out of the channel 28 and against the movement resisting engagement of the locking assembly 36 and the plurality of fingers 40. Also, disposition and structure of the locking assembly 36 including, but not limited to, the structure of the plurality of fingers 40 will cause a destruction, or at least partial deformation, of the locking assembly, as represented in FIG. 9D, as the connector pin 24 is forced outwardly from the channel 28 through the open end 30. Accordingly, the locking assembly 36 can be said to be "destructively detached" and/or displaced from a position relative to and engagement with the connector pin 24 as the pin 24 is forced outwardly from the channel 28 in the opposing direction to its direction of entry, as schematically indicated by directional arrow 55.

Once the base 12 and the attachment member 14 are separated from their intended operative position, connector pin 24 may also be easily removed from the merchandise 18. Therefore, the deformation or at least partial destruction of the locking assembly 36 will most probably render the associated attachment member 14 incapable of further use. Accordingly, the attachment member 14, once forcibly detached from the connector pin 24, such as in the manner described above, may be considered disposable. In contrast the base 12, as indicated above, can be repeatedly used by having others of a plurality of attachment members 14 independently connected thereto in the aforementioned and preferred operative position.

Figure 7:
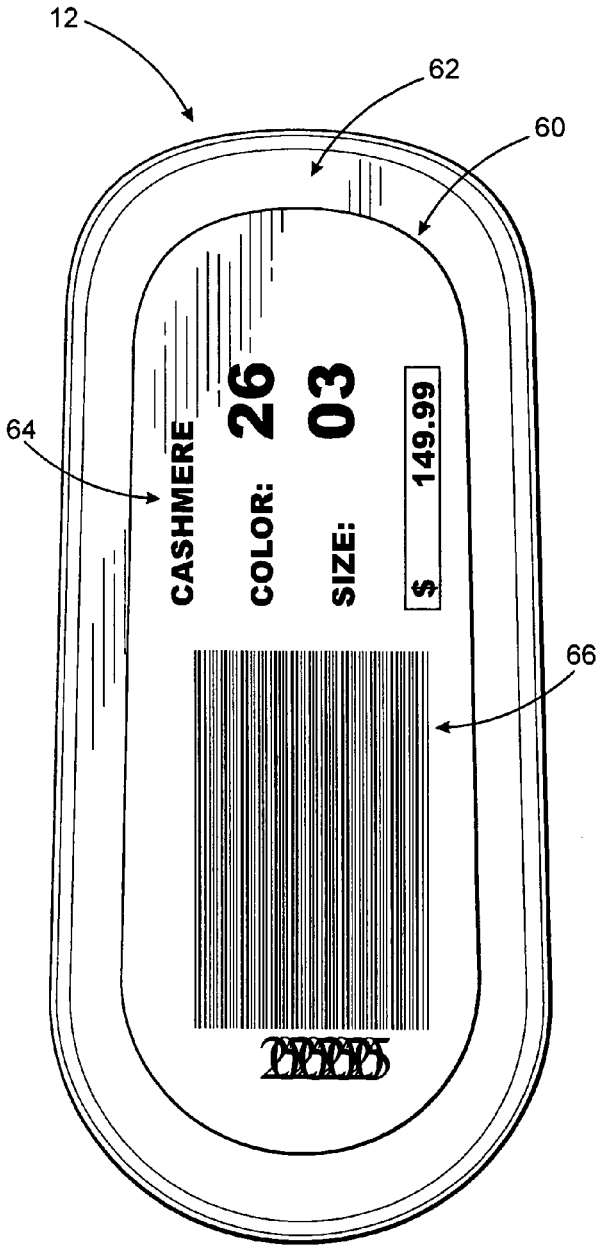
FIG. 7 is a rear view of the embodiment of FIG. 2.
Figure 5:
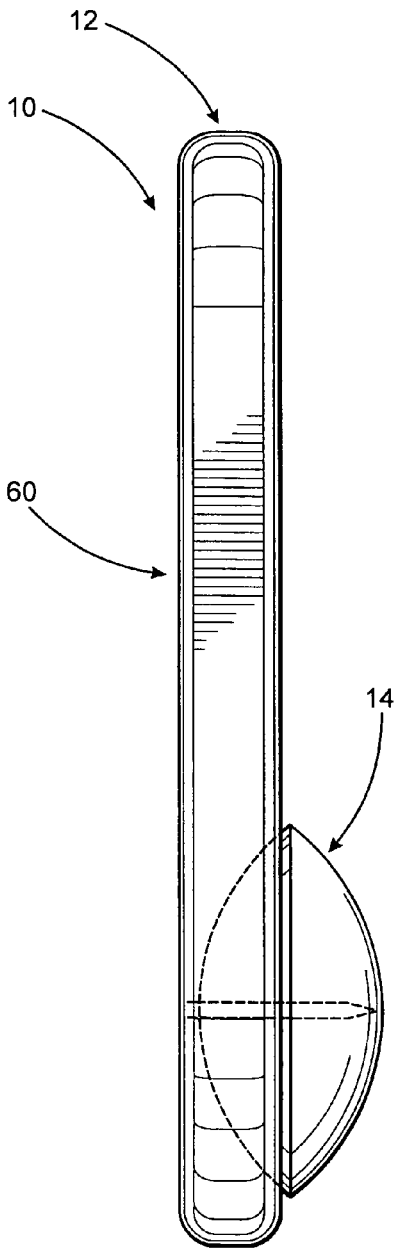
FIG. 5 is a right side view of the embodiment of FIG. 2.
Figure 8:
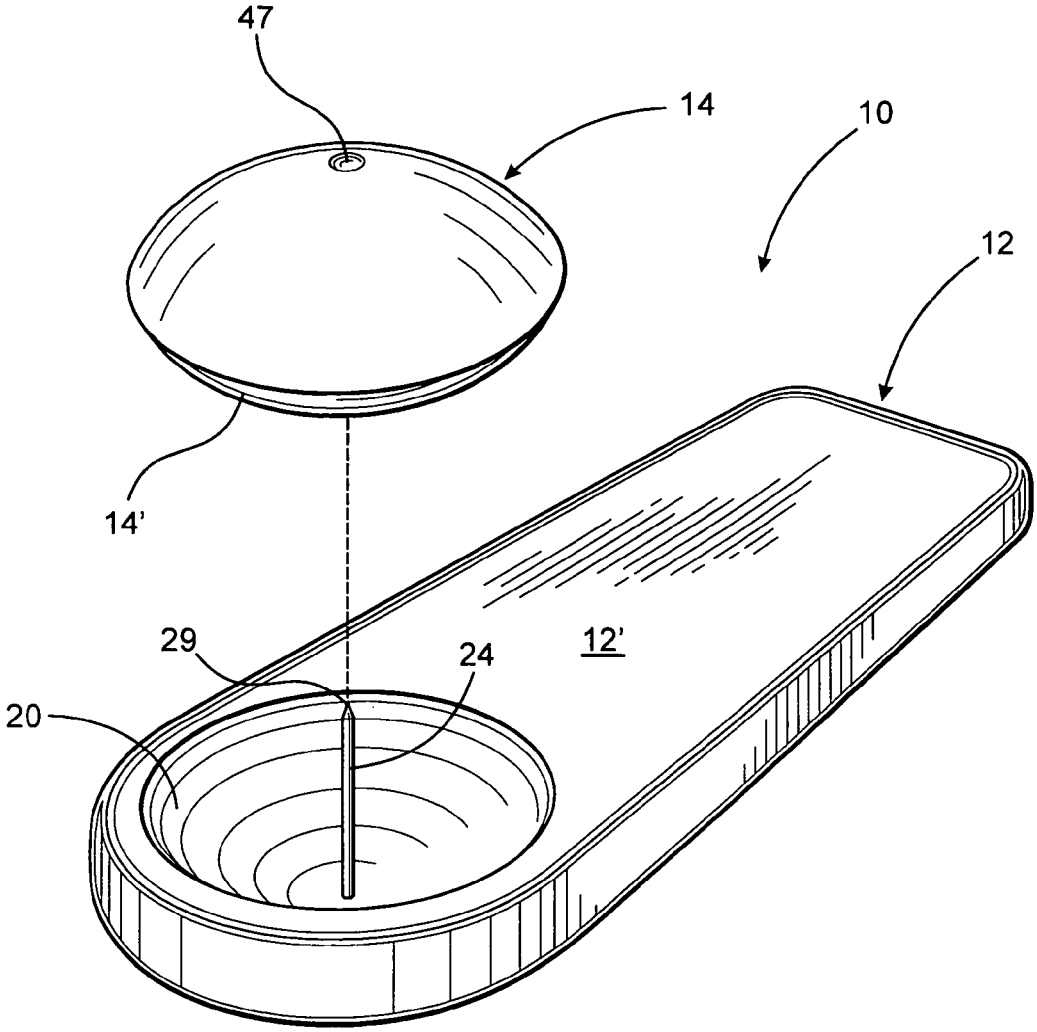
FIG. 8 is a perspective view in exploded form showing a separation of the various operative components of the embodiments of FIGS. 1 through 7.

With primary reference to FIG. 7, yet another structural feature incorporated in at least one preferred embodiment of the present invention is the provision of a display field generally indicated as 60. The display field 60 is formed on any one of a plurality of different exterior surface portions of the base 12 such as on a rear or undersurface 62. The size and configuration of the display field 60 may vary and is at least partially dependent on the size, dimension and configuration of the base 12 as well as the intended informative data or information, generally indicated as 64, intended to appear thereon. The informative data 64 may include different information sections including a bar code, optical other electrically scanned indicia 66 and/or one or more plurality of printed data sections. The content of the predetermined information and/or data provided for viewing and external exposure would include merchandise information and/or other information regarding the origin, manufacture, distribution history, etc., associated with the merchandise 18 being protected. Other informative data may include physical characteristics of the merchandise or product 18 including size, color, material as well as the pricing thereof. The predetermined data or information, including such information identified as merchandise data is intended to be only representative of a variety of different information and/or data segments or portions which may appear in the display field 60.

Further, the predetermined data or information may be permanently, fixedly and/or removably secured within the display field 60 such as by a labeling and/or by an otherwise fixed and/or secured structuring extending over at least a portion of a corresponding surface 62. Also, the inclusion of the display field 60 can result in time and cost saving features, such as by connecting the security tag assembly 10 at the manufacturing site and thereby "identifying" the merchandise at this point in the product distribution system. By way of example, many products with which the security tag assembly 10 may be used are manufactured in locales having labor costs which are significantly lower than in the geographical location where the products are sold. Therefore, attachment of the security tag assembly 10, having the display field 60 and pertinent data 64 appearing thereon, at the manufacturing site, rather than at the retail outlet, could result in significant savings in labor costs, while assuring that the product is properly marked, described, identified, etc.

Figure 11:
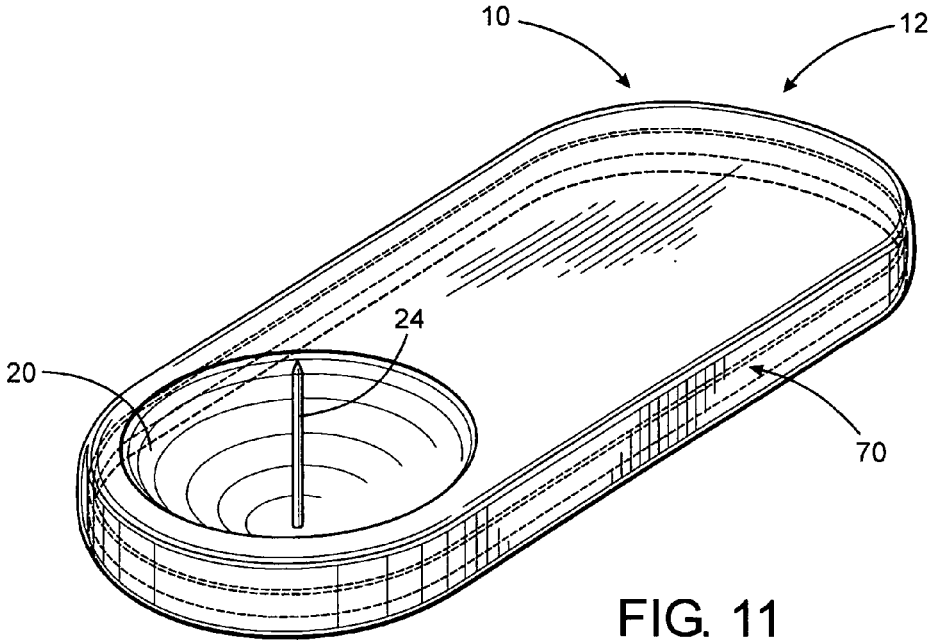
FIG. 11 is a perspective view of yet another preferred embodiment of the present invention incorporating an indicator assembly.
Figure 12:
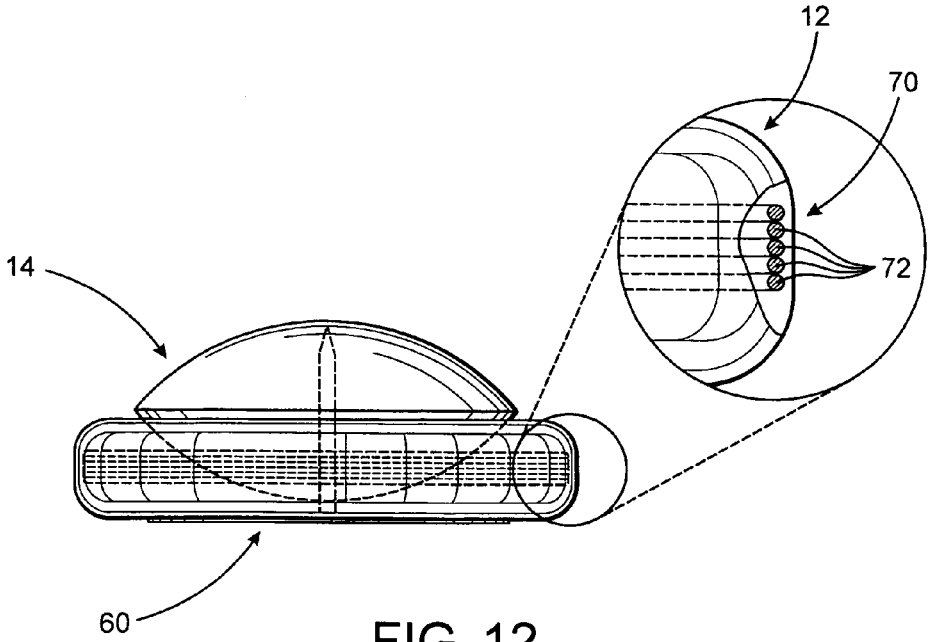
FIG. 12 is a front view and an exploded detail view showing structural details of the embodiment of FIG. 11.

With primary reference to FIGS. 11 and 12, at least one preferred embodiment of the security tag assembly 10 of the present invention comprises an indicator assembly generally indicated as 70. The indicator assembly 70 is mounted and/or connected to the base 12 on at least a portion of the interior thereof as shown in detail in FIG. 12. In a most preferred embodiment of the indicator assembly 70 is formed from a plurality of conductive material coil segments or strands 72. The coil strands 72 may have an at least partially continuous configuration as they are collectively arranged and extend along at least a portion of the periphery of the base 12. As such, the indicator assembly 70 is capable of activating an alarm such as, but not limited to, a proximity alarm of the type typically found and/or associated with entrances and exits of retail establishments. In addition, the indicator assembly 70 comprising the multi-stand construction 72 is structured, configured and disposed to define a radio frequency (RF) coil capable of facilitating RF communication and/or signaling. As such, the RF coil may be modified to demonstrate "tracking" capabilities for the merchandise 18 to which it is attached.

Figure 13:
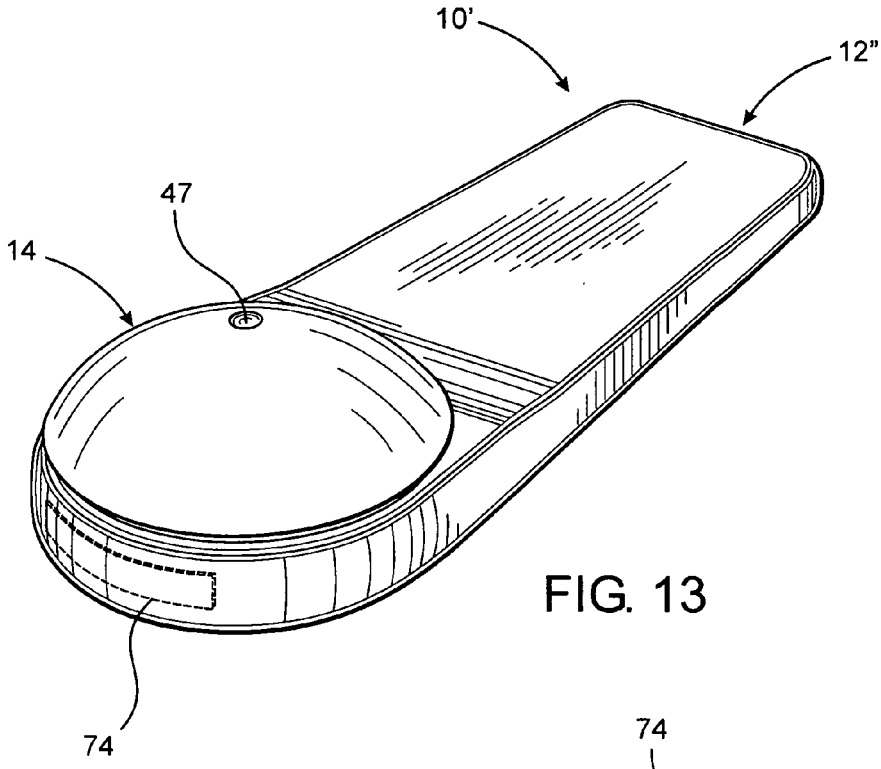
FIG. 13 is a perspective view of yet another preferred embodiment of the present invention shown representing an operative and structural modification from the embodiment of FIGS. 11 and 12.
Figure 14:
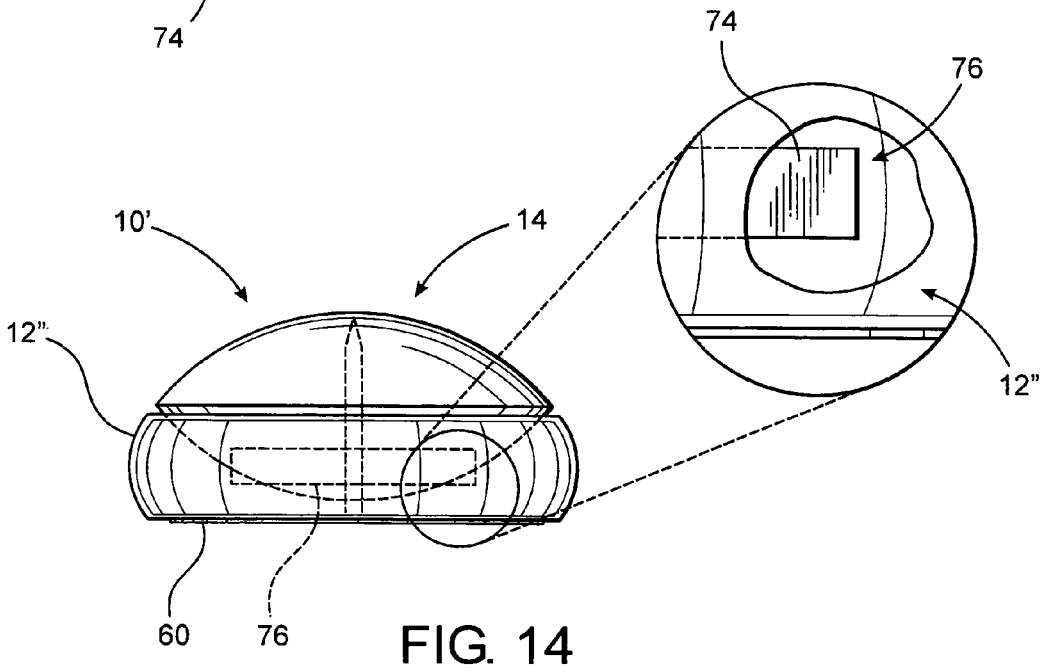
FIG. 14 is a front view and exploded detail view showing structural and operative details of the embodiment of FIG. 13.

Yet another preferred embodiment of the present invention is represented in FIGS. 13 and 14. More specifically, the security tag assembly 10' comprises a base 12" and is structured, similar to the embodiments of FIGS. 1 through 12, to be connected to and used in combination with any one of a plurality of replaceable and disposable attachment members 14. Moreover, various components of the base 12" and the one or more attachment members 14 are equivalently structured to operate in the same manner as described above with specific reference to FIGS. 1 through 12. However, the security tag assembly 10' is distinguishable from the above-noted embodiments through the provision of a base 12" having a varied or modified configuration from that of base 12. More specifically, the base 12" may be somewhat thinner and/or tapered as clearly represented. This alteration in the overall configuration of the base 12" may be at least partially due to the provision of an indicator assembly 74 mounted on and/or connected to the base 12" preferably on the interior thereof in a somewhat hidden location. As such, the indicator assembly 74 includes a conductive or other appropriate material indicator member 76 which is specifically structured, disposed, configured, etc. relative to the structural features of the base 12" to activate an alarm such as, but not limited to, a proximity type of alarm commonly associated with exits and entrances of retail establishments.

In comparing the different preferred embodiments of FIGS. 11, 12 and 13, 14 it is emphasized that the specific structural features in terms of dimensions and configurations may vary from those represented. However, the overall structure of the base 12 and/or 12" should be readily adaptable to the mounting or connection thereto of an indicator assembly 70, 76 and/or a combination of both. Also, while the specific embodiments represented in FIGS. 11 through 14 of an indicator assembly 70 and 76 are specifically disclosed, other indicator assemblies may be provided which include the capability of activating an alarm of the type set forth above.

With primary reference to FIGS. 15 through 19, yet another preferred embodiment of the present invention is directed to a security system incorporating a security tag assembly 10, 10' which includes the structural components of a base 12, 12" and an attachment member 14, as described in detail with reference to the preferred embodiments of FIGS. 1 through 14. As such, the security tag assembly 10, 10' is meant to include the various structural features of the base 12, 12" and the attachment member 14 with reference to the above described preferred embodiments including, but not limited to, the locking assembly 36, the interior channel 38 and the open and closed ends 30 and 32 respectively. Similarly, the additional preferred embodiment of the detachment assembly 50' includes an elongated drive shaft 52 positionable in accord with directional arrow 53 to accomplish forced removal of the connector member 24 from the locking assembly 36 and the interior of the attachment member 14. As a result, detachment between the base 12, 12" and the attachment member 14 will be efficiently accomplished as described above in detail with reference to FIGS. 9A through 9D.

Structural and operative modifications of the preferred embodiment of the detachment assembly 50' include an essentially automatically operating protocol which serves to detach the base 12, 12' from an associated one of the attachment members 14, such that the security tag assembly 10, 10' is no longer in its operative position, being connected to a protected merchandise, product, etc. With primary reference to FIGS. 15 and 16, the detachment assembly 50' includes various operative components which also facilitate the communication of the merchandise data from the display field 60 to the data registering processor 90 (see FIG. 18), for the processing thereof. As described above, the merchandise data may include, but not be limited to, information at least partially relating to the product or merchandise being protected and be in the form of indicia 64, bar code 66 and other display formats. To accomplish its intended purpose, the detachment assembly 50' includes a positioning sensor 80 structured to sense the mounting or connection of the security tag assembly 10, 10' in the intended position of FIG. 15. When so oriented, authorized detachment of the base 12, 12" and the attachment member 14, as well as the attendant removal of the security tag assembly 10, 10' from its operative position on the protected merchandise, may be efficiently accomplished.

In addition, the detachment assembly includes a detachment structure 82 which includes the drive shaft 52 as well as other structural features described in greater detail with reference to the embodiment of FIGS. 9A through 9*d*. As previously described, forced travel of the drive shaft 52, in accord with directional arrow 53, will cause a forced detachment of the connector member 24 from the interior of the attachment member 14 and disengagement from the locking assembly 36, generally causing its destruction, deformation, etc, as described above. However, rather than being manually operated in the manner described with reference to FIG. 10, drive shaft 52 is automatically operative by other means such as solenoid drive facility or other appropriate driving assemblies capable of accomplishing the forced travel of the drive shaft 52.

The detachment assembly 50' further includes a holding assembly 84 which serves to secure and stabilize the security tag assembly 10, 10' when disposed in the intended position of FIG. 15. When so stabilized, drive shaft 52 can forcibly remove the connector member 24 from its retained position on the interior of the attachment member 14 and out of retaining engagement with the locking assembly 36. Except for automating its activation and operation, the structural details of the holding assembly 84 may be substantially equivalent to the embodiment represented in FIGS. 9A through 9D. Such equivalent features include the holding or stabilizing members 54 engaging an appropriate portion of the attachment member 14.

With further reference to FIGS. 15 and 16, the detachment assembly 50' further includes a reader assembly 86 disposed and structured to clearly observe the display field 60 and various portions of the merchandise data including the indicia 64 and/or the bar code 66. The reader assembly 86 is schematically represented and may be defined by any of a variety of different optical reading and/or scanning facilities capable of the optical reading of the merchandise data 64 and/or 66 and the converting of such data, once optically read or scanned, into a digital or other communicative format. Once so converted, the merchandise data 64 and/or 66 is directed to a communication assembly 88 which is also incorporated within and considered a part of the detachment assembly 50'. The communication assembly 88 may assume a variety of different operative and structural configurations including hard wire connections and/or wireless facilities structured to communicate the merchandise data to the data registering processor 90 generally and schematically indicated in FIG. 18.

The data registering processor 90 is intended to include a variety of performance characteristics capable of processing the merchandise data received from the detachment assembly 50'. By way of example, the data registering processor may serve as a cash register or like "check-out" processor and preferably include a display screen and/or monitor 92 and an operative control assembly 94. Further, the control assembly 94 may include, but is not intended to be limited to, a manual input facility, such as a keyboard assembly, as well as other operative components.

Therefore, it is emphasized that the detachment assembly 50' through the provision of the communication assembly 88 establishes either a hard wire or wireless communication link between it and the data registering processor 90. To accomplish the aforementioned two-way communication, the data registering processor 90 also incorporates a cooperatively functional communication assembly 96. The specific structural and operational features of the communicating assemblies 88 and 96 respectively associated with the detachment assembly 50' and the data registering processor 90 may vary and, as set forth above, may be either hard wired or operative through wireless communication. By way of example, the communication assemblies 88 and 96 could be embodied in appropriately operative devices incorporating nanotechnology, rather than the more conventional hardwired or wireless transceiver structures described herein. Similarly, the above noted indicator assemblies 70 and 76, rather than assuming the physical characteristics as represented in FIGS. 12 through 14, could comprise communicative and/or signaling devices incorporating nanotechnology. As such, the versatility and effectiveness of the security system, security tag assembly and the various operative components associated therewith may be significantly enhanced Yet additional structural and operative features of the detachment assembly 50' include an activity display 87 which preferably comprises a plurality of visual indicators 100 through 103 which may be in the form of different colored lights or other appropriate visual indicators. The activity display 87 is disposed and structured to indicate the current operative activity of the detachment assembly 50', wherein each of the indicators 100 through 103 is structured and disposed to indicate a different one of a plurality of operative activities of the detachment assembly 50'. As will be described in greater detail with primary reference to FIG. 18, the plurality of operative activities at least comprise engagement of the holding assembly 84 with the security tag assembly 10, 10'; the reading of the merchandise data 64 and/or 66 from the display field 60 by the reader assembly 86; the communication of the optically read merchandise data 64 and/or 66 from the detachment assembly 50' to the data registering processor 90 through operation of the respective communicating assemblies 88 and 96; the receipt and processing of the merchandise data by the data registering processor 90 and the release of the security tag assembly 10, 10' by means of separating the base 12, 12" from the attachment member 14 substantially concurrent with the removal of the security tag assembly 10, 10' from the detachment assembly 50'.

Figure 19:
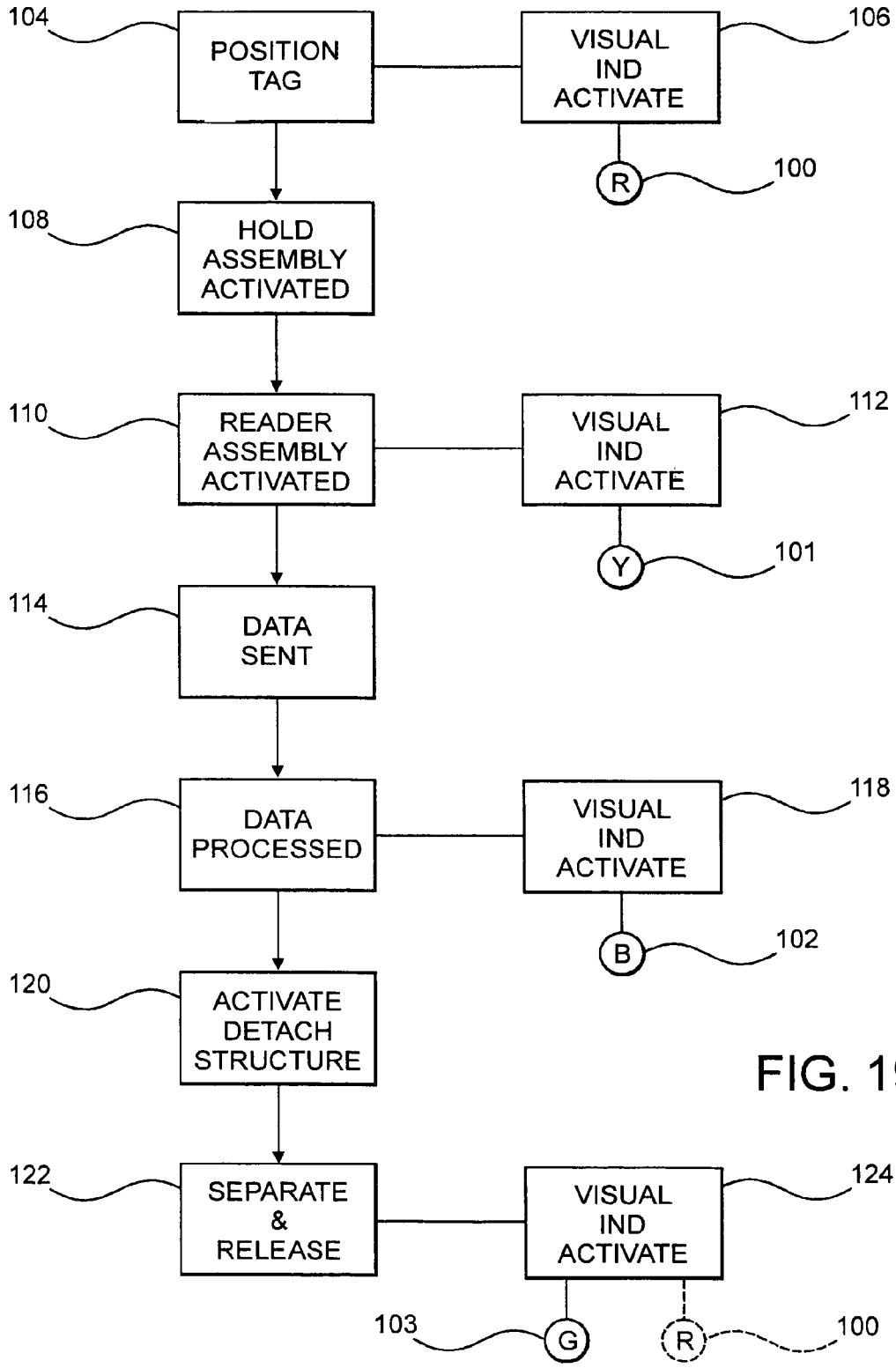
FIG. 19 is a schematic representation in block diagram form of the operation and practice of the security system of the present invention.

Therefore, the practice and operation of the security system embodiment represented in FIGS. 15 through 18 is schematically represented in FIG. 19. More specifically, when a product or merchandise is being purchased it is of course necessary to remove the security tag assembly 10, 10'. Accordingly, authorized removal of the security tag assembly 10, 10' comprises its positioning or orientation in association with the detachment assembly 50', as at 104. When such occurs, the positioning sensor assembly 80 will sense the presence of the security tag assembly 10, 10' which is being detached from its operative position on the merchandise being protected. Concurrently, at least one of the plurality of visual indicators 100 of the activity display 87 will be activated as at 106. For purposes of clarity, the plurality of visual indicators 100 through 103 are represented as lights, LED's, etc. of different colors wherein the designations R, Y, B and G are respectively indicative of the red, yellow, blue and green coloring of the lights or other visual indicators 100 through 103.

When the security tag assembly 10, 10' is properly positioned relative to the detachment assembly 50', the holding assembly 84 is activated, as at 108, such as by interaction with the position sensor 80, to the extent that the holding or stabilizing members 54 appropriately engage the security tag assembly 10, 10' in the manner represented in FIG. 9D and described above. The security tag assembly 10, 10' is thereby properly stabilized and firmly but removably secured in its intended orientation relative to the detachment assembly 50'. Further, this stabilized securement allows a detachment of the base 12, 12" and the associated attachment member 14 through forced travel of the drive shaft 52 in the direction indicated by directional arrow 53. (See FIGS. 9D and 15). However, as will be indicated hereinafter, the detachment of the base 12, 12" and attachment member 14 will be delayed until the processing of the merchandise data and purchase of the protected merchandise has been otherwise completed.

Upon the proper orientation or positioning of the security tag assembly 10, 10' relative to the detachment assembly 50' the reader assembly 86 is automatically activated, as at 110. The activation and operational activity of the reader assembly 86 is indicated by activation of the visual indicator 112 comprising an illumination of the visual indicating light 101, which may be yellow or any other appropriate color. Upon being optically read, the merchandise data is then communicated, as at 114, to the data registering processor 90 where the merchandise data is processed, as at 116. As described above, the data registering processor 90 comprises the display 92 wherein at least a portion of the merchandise data may be displayed on the screen or monitor 92. In addition, further manual or automatic input may be accomplished by means of the control assembly 94. Accordingly, it should be apparent that the data registering processor 90 may serve as a cash register type facility and include the various operational and processing steps eventually associated therewith. Such steps include but are not limited to display of the indicated price, quantity, etc, of the merchandise and the presentation of a hard copy receipt as well as the indication and logging of acceptable payment received for purchase of the merchandise. Concurrently, one of the plurality of visual indicators 102, schematically represented as a blue light or like structure, is activated as at 118. As such, the user of the detachment assembly 50' is informed of this operational activity being currently performed by the detachment assembly 50'.

Upon completion of the purchasing procedure and other merchandise data processing 116, an intended operational or activating signal, as at 120, is communicated from the data registering processor 90 to the detachment structure 82 associated with the detachment assembly 50'. As set forth above, the detachment structure 82 comprises the drive shaft 52 being forced into the interior of the attachment member 14 causing removal of the connector member 24 therefrom and disengaging the connector member 24 from the locking assembly 36 causing the latter to destruct. This results in the base 12, 12" and the attachment member 14 being detached from one another and a separation of the security tag assembly 10, 10' from its operative position of being connected to the merchandise being protected.

Finally, as the base 12, 12" and the attachment member 14 are detached from one another, the attachment member 14 is released from the stabilized and secured engagement with the holding assembly 84, as at 122. This is automatically accomplished by an activating signal being sent to the holding assembly 84 upon a completion of the processing of the merchandise data 64, 66. Concurrently, a visual indicator such as a green or other colored light 103 is activated, as at 124, providing a clear indication of the operational activity being currently performed by the detachment assembly 50'. In at least one additional modification and/or preferred embodiment of the detachment assembly 50', the visual indicator 100, which may be defined by a red or other colored light, may remain illuminated during the entire procedure. However, upon illumination of the green indicator light 103, the red indicator light 100 may be extinguished as the security tag assembly 10, 10' or any portion thereof is removed from the detachment assembly 50' as indicated in phantom lines in FIG. 15.

With primary reference to FIGS. 20 through 23, yet another and most preferred embodiment of the security tag assembly of the present invention is generally indicated as 130. More specifically, the security tag assembly 130 is at least operationally similar to the embodiment of FIGS. 1 through 19, but at least structurally distinguishable therefrom. As such, the security tag assembly 130 comprises a reusable base 132 preferably including an elongated configuration or being otherwise structured and configured. The base 132 may include similar structural and performance features as the bases 12, 12' and/or 12" including, but not limited to, an area 60 on an exteriorly exposed portion thereof. As such, the area 60 comprises merchandise data, as at 64 and 66, as described in detail with reference to FIG. 7.

Figure 20:
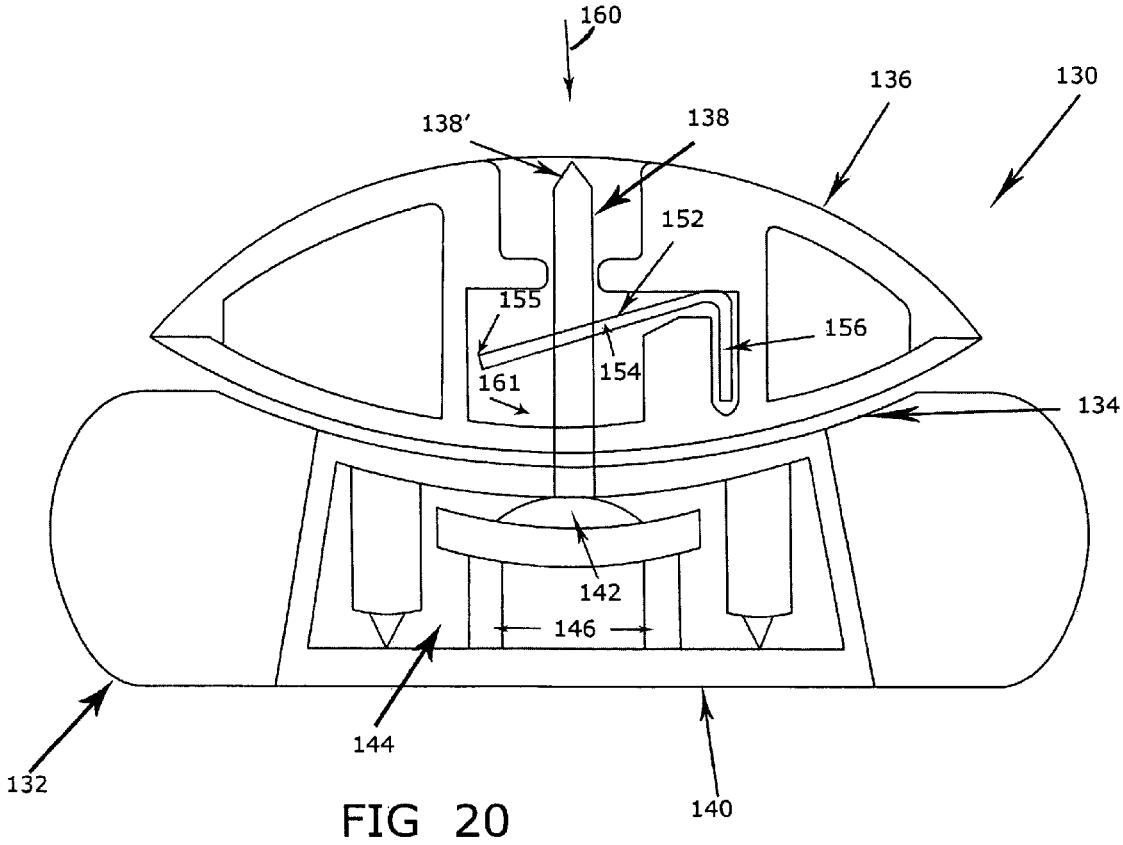
FIG. 20 is a sectional interior view of yet another preferred embodiment of the security tag assembly of the present invention.
Figure 21:
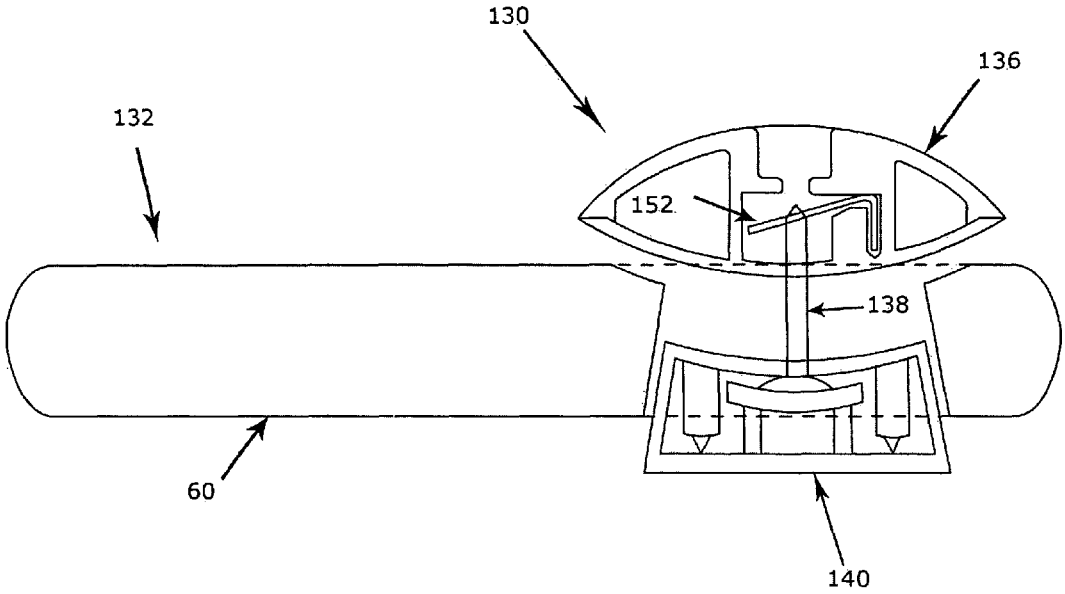
FIG. 21 is an exploded side view in section of the preferred embodiment of FIG. 20.

Also, the reusable base 132 includes a substantially concave or other appropriately configured surface area 134 for the receipt of merchandise when the base 132 and an attachment member 136 is disposed in the operative position of FIG. 20. As also described above with regards to the embodiment of FIGS. 1 through 19, when in the operative position, the base 132 and the attachment member 136 are connected to one another in clamped or otherwise attached relation to the merchandise. When so connected, the merchandise will substantially overlie the concave or other appropriately configured surface portion 134 of the base 132 and be positioned between the base 132 and the attachment member 136.

The security tag assembly 130 also includes an elongated, substantially pointed or sharpened connector member 138 disposed and structured to pass through or otherwise penetrate the merchandise being protected. The connector member 138 is secured to or connected to the base 132 and is more specifically attached to a mounting segment 140. Further distinguishing structural features of the connector member 138 and the base 132 comprise the rotational attachment or connection of the connector member 138 to the base 132. More specifically, the innermost end or head portion 142 of the connector member 138 is mounted on the interior of the mounting segment 140 and is rotatable within the chamber 144, such as by being rotationally disposed on a platform or like structure 146. As will be described in greater detailed hereinafter, the ability of the connector member 138 to rotate relative to both the base 132 and the mounting segment 140 further facilitates the inability to remove the attachment member 136 from the base 132, unless predetermined removal devices, including detachment assemblies 50 and/or 50', as well as other authorized detachment assemblies, are utilized.

Structural features of the security tag assembly 130 which are distinguishable from the embodiments of FIGS. 1 through 19 include the removable attachment of the mounting segment 140 to the base 132. As set forth above, the connector member 138 is connected directly to the mounting segment 140 and is interconnected to the base thereby. As such, the connector member 138 can be removed with the mounting segment 140 from the remainder of the base 132 by separating or detaching the mounting segment 140 from the base 132, as schematically demonstrated in FIG. 21. This facilitates or allows the replacement, and disposal of the connector member 138 and mounting segment, while still allowing the remainder of the base 132 to be reused with different ones of a plurality of attachment members 136. It is also contemplated that the mounting segment 140 can be disposable and recycled under certain conditions.

Figure 22:
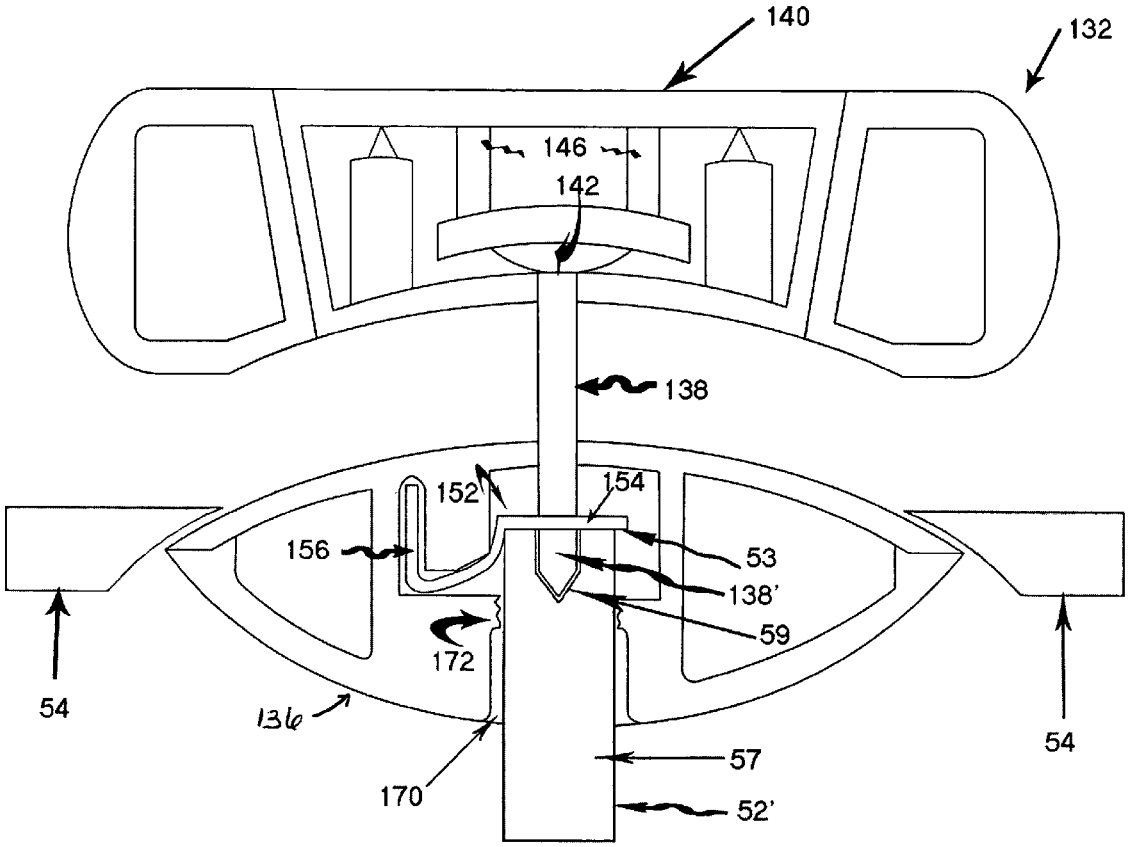
FIG. 22 is an interior sectional view in partial cutaway of the preferred embodiment of FIGS. 20 and 21.

Accordingly, the connector member 138 is movable both with and relative to the mounting segment 140 and therefore can be removable from the remainder of the base 132 possibly for repair but more likely for replacement. As set forth above, the connector member 138 is rotatable relative to the mounting segment 140 and accordingly rotational relative to the base 132 when the mounting segment 140 is secured to the base as represented in FIG. 20. Removable attachment of the mounting segment 140 to the remainder of the base 132 may be accomplished by any applicable means such as, but not limited to, a wedged, frictional engagement or by any other appropriate connecting or securing means. However, the mounting segment 140 is structured to remain in its attached position, as represented in FIG. 22, relative to the remainder of the base 132, as the attachment member 136 and the connector member 138 are detached from one another in an intended or authorized manner, as also disclosed in FIG. 22.

Figure 23:
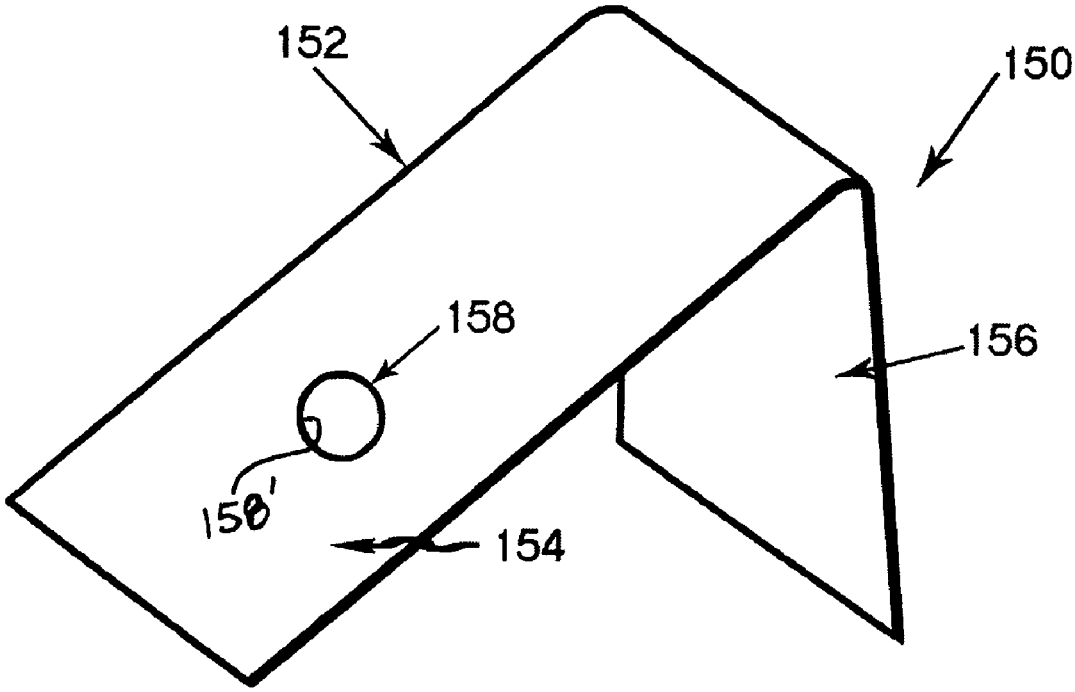
FIG. 23 is a detailed perspective view of a locking assembly associated with the preferred embodiment of FIGS. 20 through 22.

Additional structural and operative features of the preferred embodiment of the security tag assembly 130 of the present invention is directed to the locking assembly generally indicated as 150 and shown in detail as FIG. 23. The locking assembly 150 comprises a substantially elongated locking member 152 preferably, but not necessarily, in the form of a substantially "L" shaped configuration. As such, the "L" shaped locking member 152 includes an elongated first portion 154 and an elongated second portion 156, which may include a shorter longitudinal dimension. In further defining the "L" shaped configuration, the second portion 156 may be considered a base of the "L" shaped configuration, wherein the first portion 154 comprises the outwardly extending leg of the "L" shaped configuration, each of which at least initially include a generally linear shape. The second portion 156 is substantially anchored in a fixed location on the interior of the attachment member 136 so as to at least partially provide stability and assure proper placement of the locking member 152. The locking member 152 is preferably formed from a flexible yet deformable material such as metal, plastic, etc. In addition, the at least initial configuration of the locking member 152 is such that first portion 154 is originally and normally disposed in what may be referred to as a first position. The first position, as demonstrated in FIGS. 20 through 22, comprises a skewed or angular orientation relative to the length or longitudinal axis of the connector member 138 when the locking member 152 is disposed in its intended position in engagement therewith. Further, the first portion 154 includes an aperture construction comprising at least one opening or aperture 158 formed in the first portion 154. Accordingly, when the first portion 154 is in the first position and is angularly oriented, as set forth above, at least a portion of the periphery 158' of the aperture or opening 158 is disposed in a movement restricting orientation or position. As described in greater detail herein, the movement restricting orientation or position of the first portion is preferably and more specifically defined by a movement restricting engagement of at least a portion of the periphery 158' with the outer surface of the connector member 138.

In addition, the flexible nature of the locking member 152 as well as the placement and dimension of the aperture 158 facilitates the connector member 138 initially passing into the interior of the attachment member 136 and the pointed or free end 138' of the connector member 138, passing through the aperture 158 of the first portion 154 of the locking member 152. As such, the attachment member 136 is easily disposable in its operative position and in clamping or otherwise secure engagement with the merchandise connected between the corresponding surfaces of the base 132 and the attachment member 136. However, attempts to withdraw or forcibly remove the connector member 138 out of the attachment member 136, in a direction schematically indicated by the directional arrow 160, will result in the free end 155 and a remainder of the first portion 154 being "pulled" or otherwise forced inwardly, generally, but not exclusively, in the direction schematically indicated by arrow 161. This will further facilitate a frictional, wedging and binding and/or other movement restricting engagement between at least a portion of the periphery of the aperture 158 and the exterior surface of the connector member 138.

Also, because the connector member 138 is rotationally mounted on or connected to the base 132 and mounting segment 140, any attempt to remove the attachment member 136 from the base 32 by attempting to rotate the attachment member 136 relative to the base 132 will be ineffective. Moreover, because of the movement restricting engagement between the periphery of the aperture 158, locking member 152 and the exterior surface of the connector 138, attempted rotation of the attachment member 136 will serve to rotate the connector member 138 relative to the base 132. Therefore an individual will not be able to "unscrew" the attachment member 136 from the base 132 since the attachment member 136 and the connector member 138 are connected to and movable with one another in that they are interconnected by the locking member 152. As such, any attempt to rotate or "unscrew" the attachment member, will only result in the attachment member 136 and the connector member 138 rotating with one another, relative to the base 132 and mounting segment 140.

With primary reference to FIG. 22, authorized removal of the attachment member 136 from the base 132, such as when the protected merchandise is being appropriately removed from a monitored area, may be accomplished by anyone of the detachment assemblies 50, 50' etc. As set forth above, other devices, hardware, etc. may be utilized. However, one preferred structural modification comprises the drive shaft 52' having an at least partially hollow structure. As such, the interior of the free end 53 of drive shaft 52' is dimensioned and configured to engage and preferably enclose at least the pointed end 138' as well as an adjacent portion of the connector member 138. More specifically, the free end 53 is at least partially open or hollow and preferably configured to substantially correspond to the pointed end 138' as indicated as 59 in FIG. 22. Accordingly, as the drive shaft 52' passes into the interior of the attachment member 136, the hollow interior of the free end 53 passes over and at least partially encloses the pointed end 138' of the drive shaft 52'.

Also, structural modifications of the attachment member 136 include a recess or opening 170 in the attachment member which has a sufficient transverse dimension to receive the distal, free end 53 of the drive shaft 52' in aligned, enclosing relation with the pointed end 138' and the remainder of the connector member 138. Further forced entry of the drive shaft 52' causes a breaking or destruction of at least a surrounding partition or like structural portion 172 by the free open end 53. Upon entry and continued movement, the free end 53 engages and forcibly deflects or deforms the first portion 154 of the locking assembly 152. Moreover, the drive shaft 52' may be forced into deflecting engagement with the first portion 154 until the first portion 154 assumes a "flattened" or "sufficiently transverse" orientation relative to the length or longitudinal axis of the connector member 138, as demonstrated in FIG. 22. This "sufficiently transverse" second or "release position or orientation" of the first portion 154 will result in the peripheral portions 158' of the aperture 158 being disposed out of the aforementioned movement restricting position and/or engagement with the outer surface of the connector member 138. It is emphasized, that when the first portion 154 is forced into the flattened or sufficiently transverse second or release position, as represented in FIG. 22, portions of the periphery 158' of the aperture 158 may or may not engage the exterior surface of the connector member 138. However, even if at least a portion of the periphery 158' still engages the connector member 138, such engagement will not be a "movement restricting" and/or "binding" engagement in the sense that any such existing engagement will be insufficient to prevent detachment of the connector member 138 from the attachment member 136, upon the forced positioning of the drive shaft 52', as represented in FIG. 22.

With further reference to FIG. 22, it is seen that a remaining portion 57 of the interior of the drive shaft is solid or otherwise structured to exert a driving force on the connecting member 138, as the drive shaft 52' continues its passage into the attachment member 136. As described with reference to the structure of FIGS. 9C and 9D, gripping jaws or like structures 54 maintain the attachment member 136 firmly but removably secured to an appropriate detachment assembly which is not shown in detail in FIG. 22.

Accordingly, the attachment member 136 can be removed from the connector member 138, as the drive shaft 52' forces the connector member 138 out of the interior of the attachment member, as should be apparent. It is to be noted, that the forced deflection and/or deformation of the first portion 154 into the second or release position or orientation should be such as to substantially "flatten" or otherwise orient the first portion 154 into a more or sufficiently transverse orientation relative to the length or longitudinal axis of the connector member 138, as set forth above, rather than the skewed, angular orientation relative to the length or longitudinal axis of the connector member 138, as demonstrated in FIG. 20. The anchored positioning of the second portion 156 of the locking member 152 will provide sufficient stability to the locking member 152 so as to facilitate the forced deflection of the first portion 154 into the aforementioned second position, as represented in FIG. 22 and set forth above.

Yet another preferred embodiment of the present invention as represented in FIGS. 24 through 30 and includes a detachment assembly generally indicated as 200. The detachment assembly 200 may be operable in substantially the same manner as the detachment assemblies 50, 50', etc, at least in terms of removing an attachment member from an associated base. However, additional features of the detachment assembly 200 comprises a mounting structure generally indicated as 202 operative for the removable retention of a portable and/or handheld scanner assembly generally indicated as 204 in an operative position.

More specifically, the detachment assembly 200 includes a support base 206 including a receiving area as at 208 for the placement of a security tag assembly 10 in an operable orientation for removal of the attachment member and concurrent reading or scanning of related merchandise data. Such an operable orientation of the security tag assembly 10, of the type described in detail with referenced to FIG. 7, includes a label or like structure 60 which is mounted on the exposed surface 62 of the under surface of the base of the security tag assembly 10. As such, the label 60 includes various types of merchandise data or information 64 and 66, wherein the latter category of data 66 may be in the form of a bar code or the like. Accordingly, the scanner and/or reader assembly 204 is selectively and operably positioned in the orientation demonstrated in FIGS. 24, through 27 such that it overlies and is substantially aligned with the label 60 so as to accurately read, scan, etc. at least the bar code data 66 and possibly a remainder of the merchandise data 64.

Figure 24:
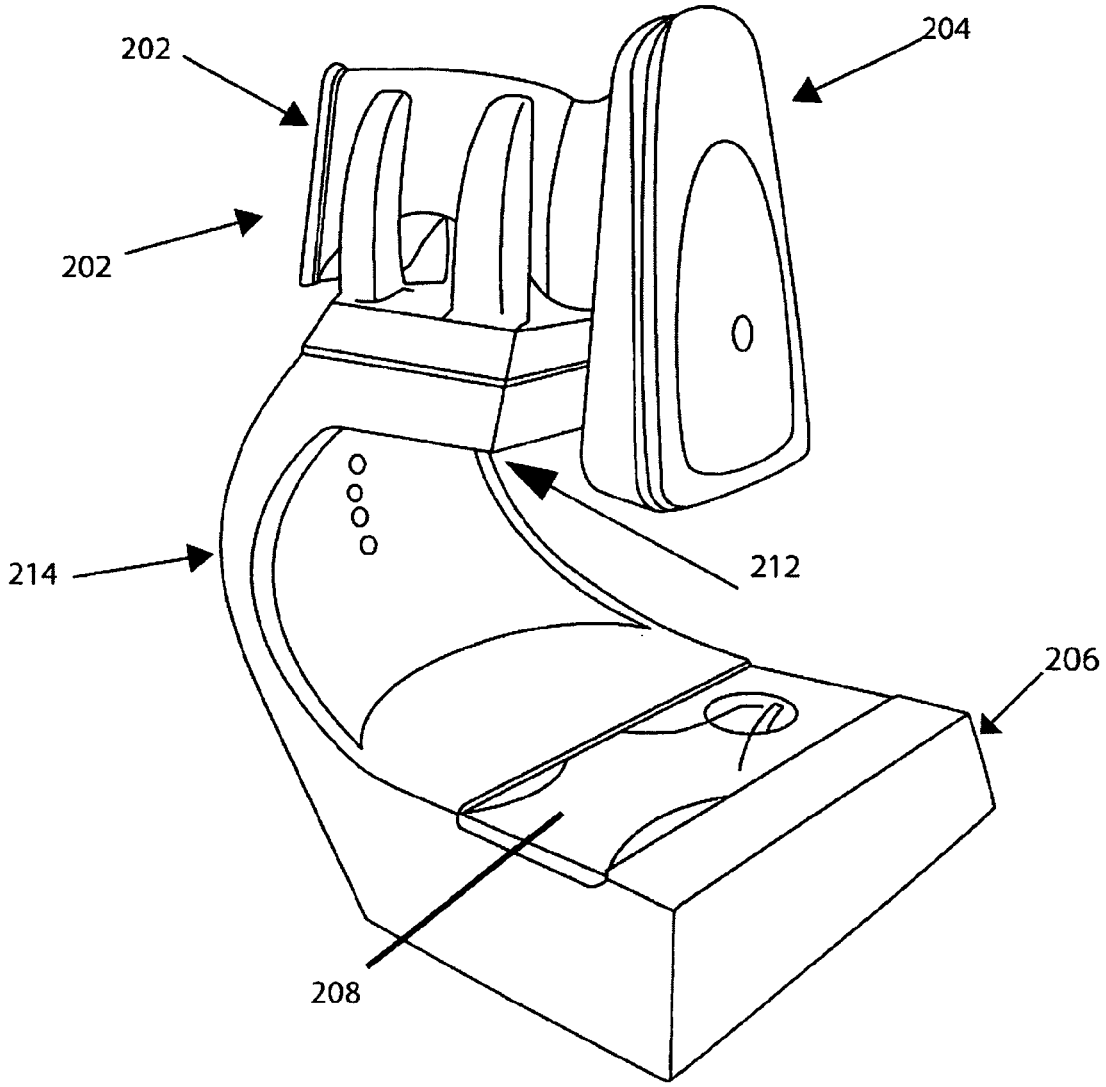
FIG. 24 is a front perspective view of yet another preferred embodiment of the present invention directed to a detachment assembly for detaching the attachment member from the base of a security tag assembly and incorporating a mounting structure for removably securing a scanner in an operable position thereon.
Figure 25:
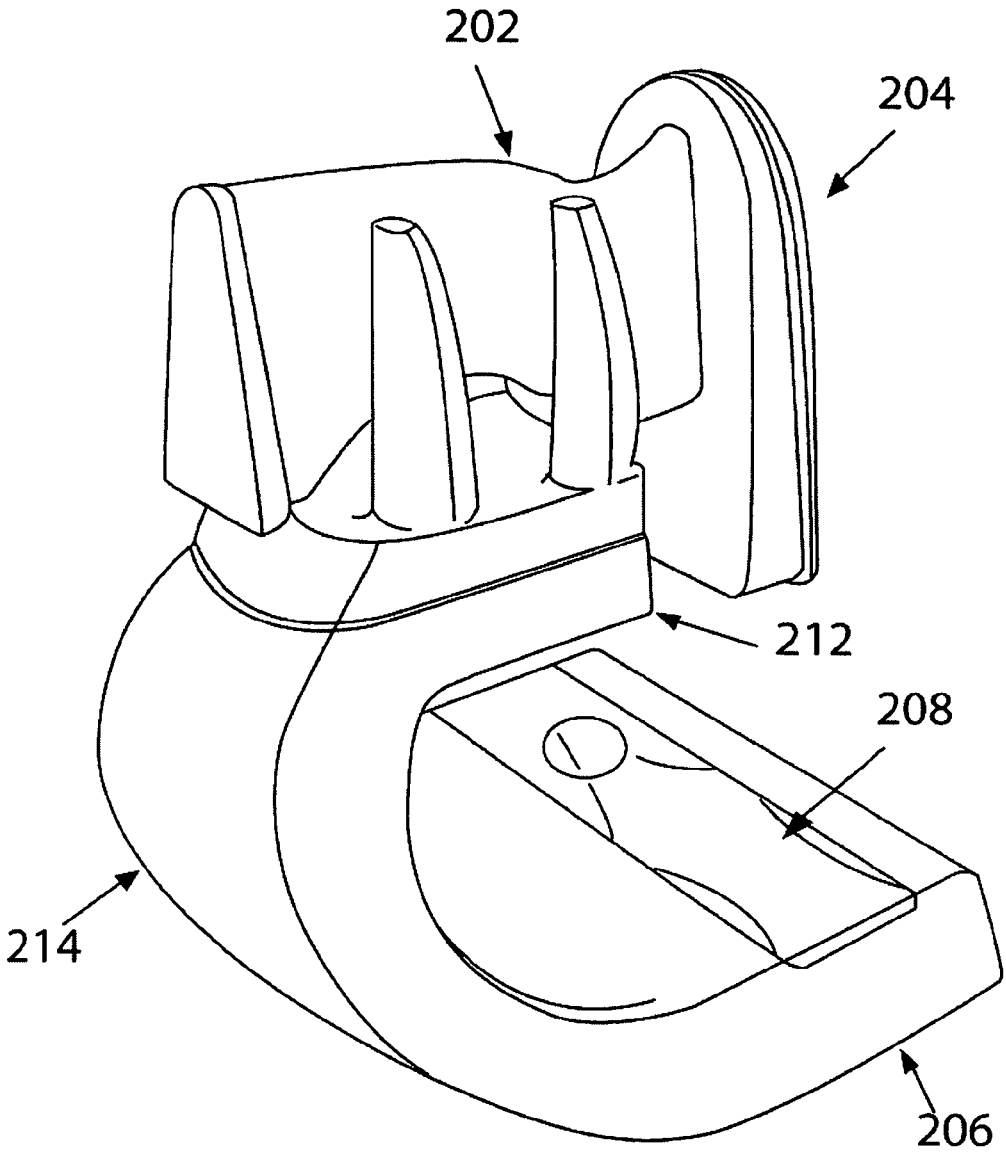
FIG. 25 is a rear perspective view of the preferred embodiment of FIG. 24.
Figure 26:
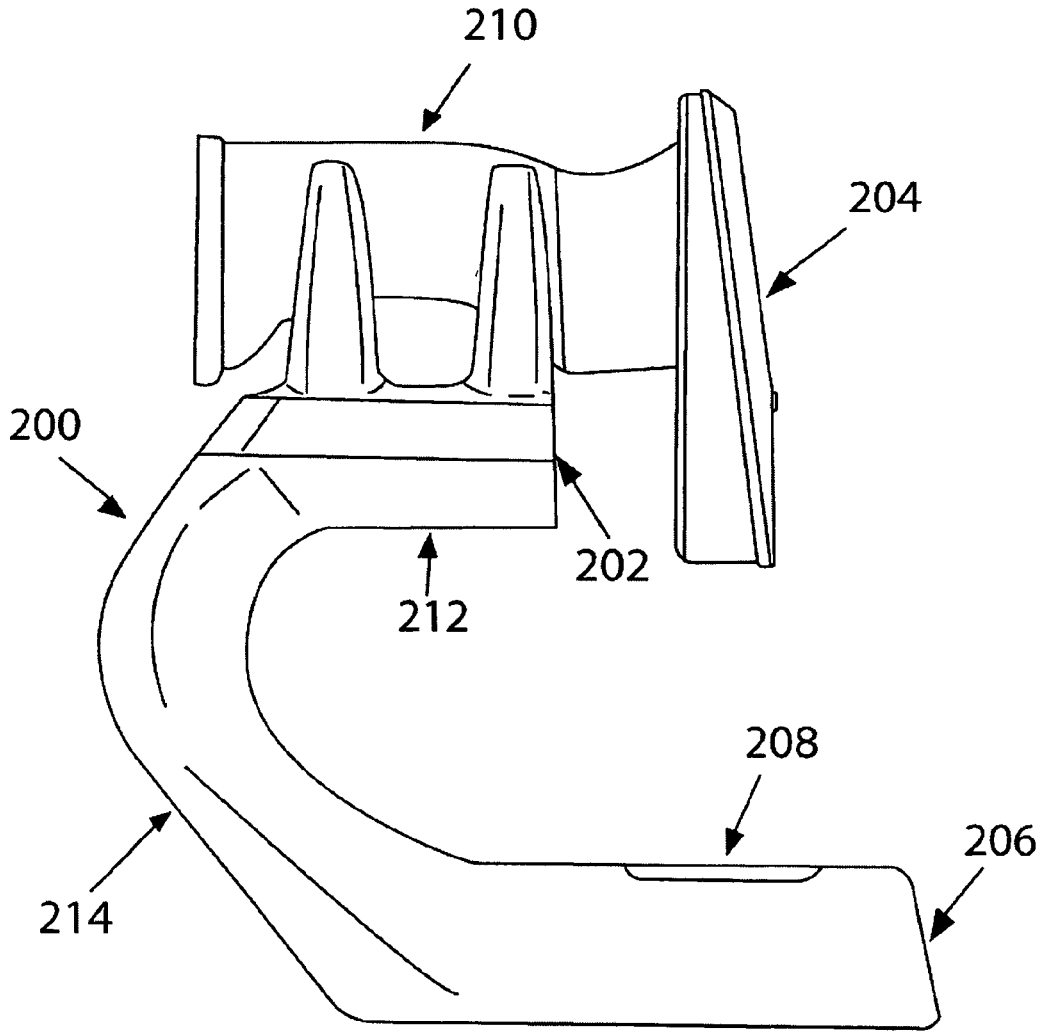
FIG. 26 is a side view of the preferred embodiment of FIGS. 24 and 25.
Figure 27:
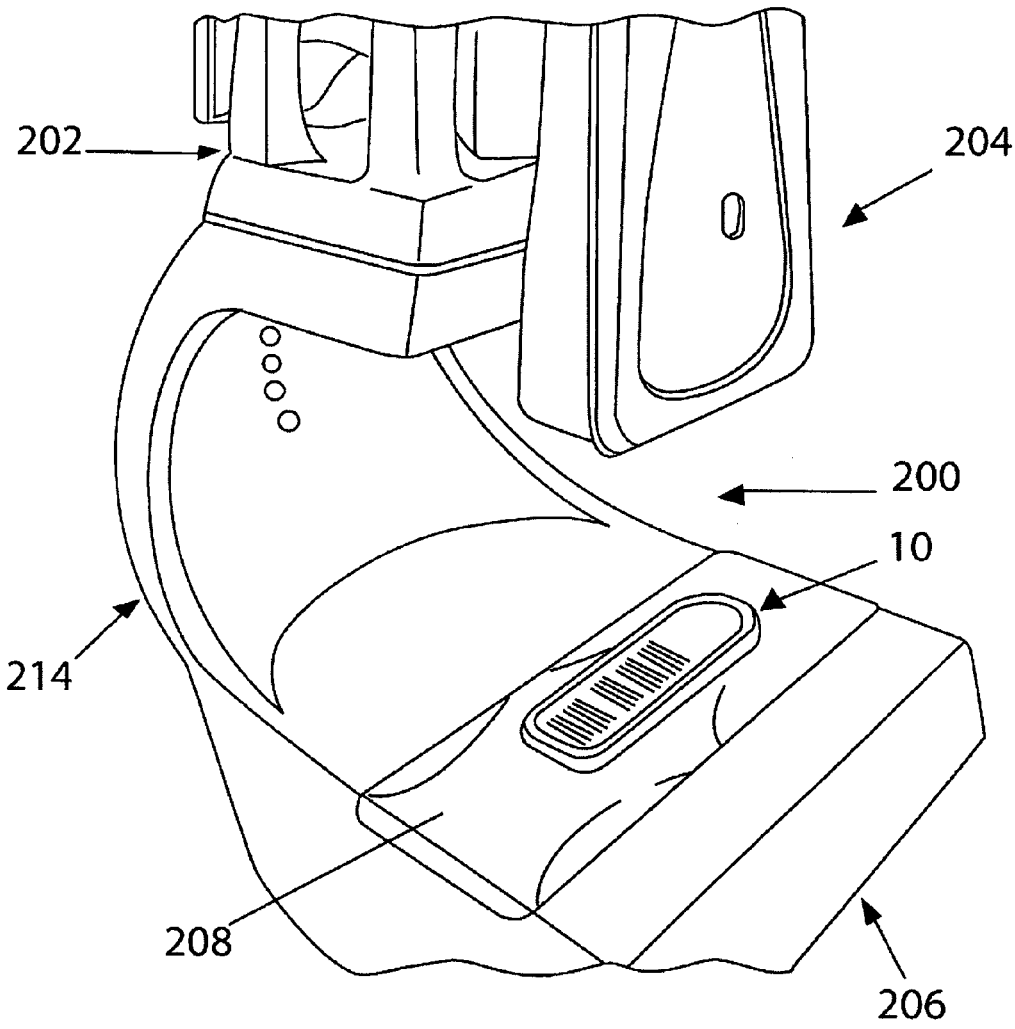
FIG. 27 is top perspective view in partial cutaway of the embodiment of the preferred embodiment of FIGS. 24 through 26 including a portable scanner assembly operatively positioned relative to the base of a security tag assembly of the embodiment of FIGS. 1 through 23, wherein merchandise data or like information is being scanned.

However, in order to provide a greater versatility in the detachment assembly 200 in terms of having it be utilized with a plurality of scanner assemblies 204, the mounting structure 202 is provided so as to removably secure the scanning assembly 204 in its intended, operable position. As such, the scanner assembly 204 may be removed therefrom and operated and utilized as a handheld or portable scanner assembly as is well known in the art. With further reference to FIGS. 24 through 26, the mounting structure 202 is specifically structured to removably retain a handle or equivalent structural portion 210 on a support pedestal 212, which is disposed in spaced relation above the support base 206 by an integrally or otherwise fixedly secured arm member 214.

Figure 28:
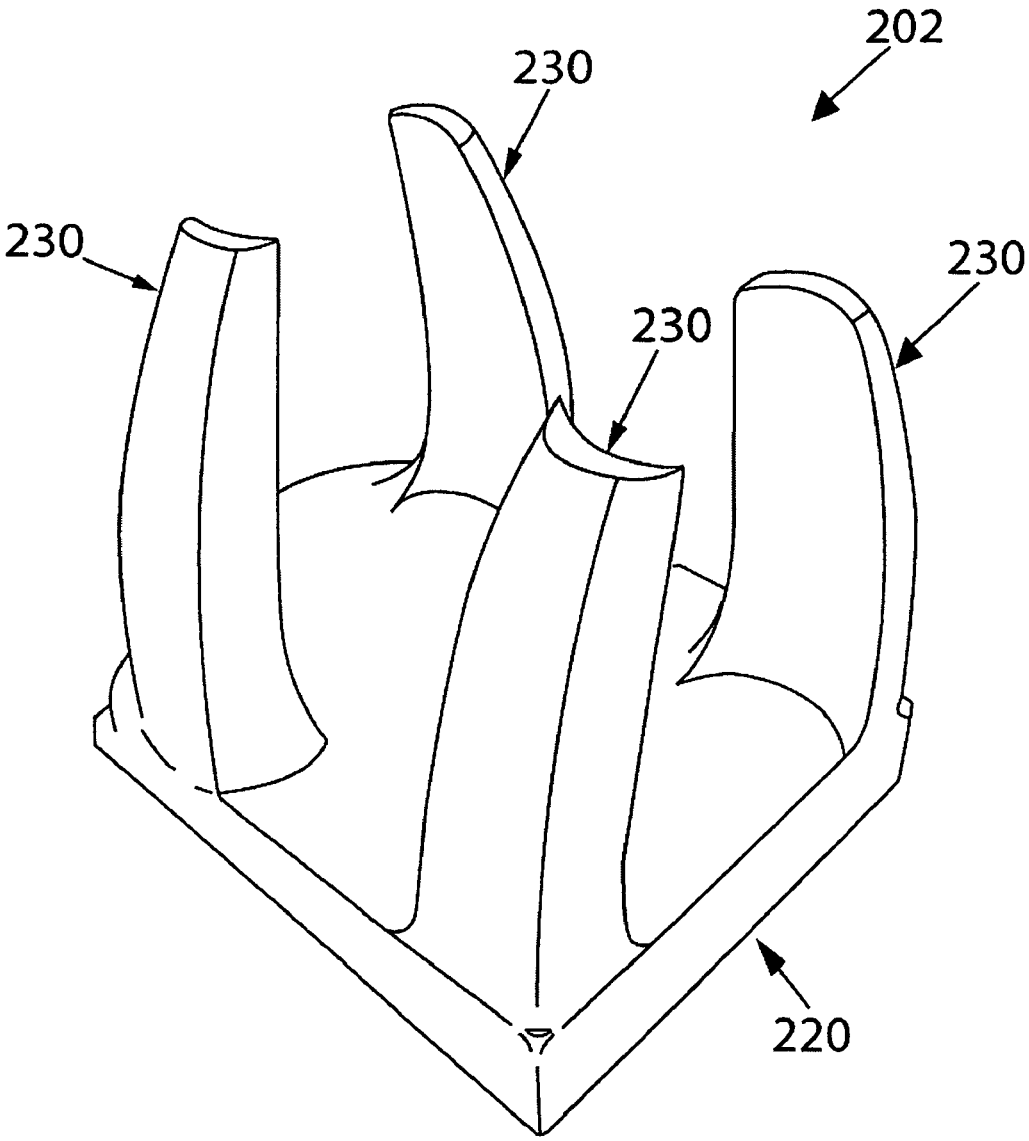
FIG. 28 is a top perspective view of the mounting structure associated with the preferred embodiment of FIGS. 24 through 27 for removably retaining a scanner in an operable position.
Figure 29:
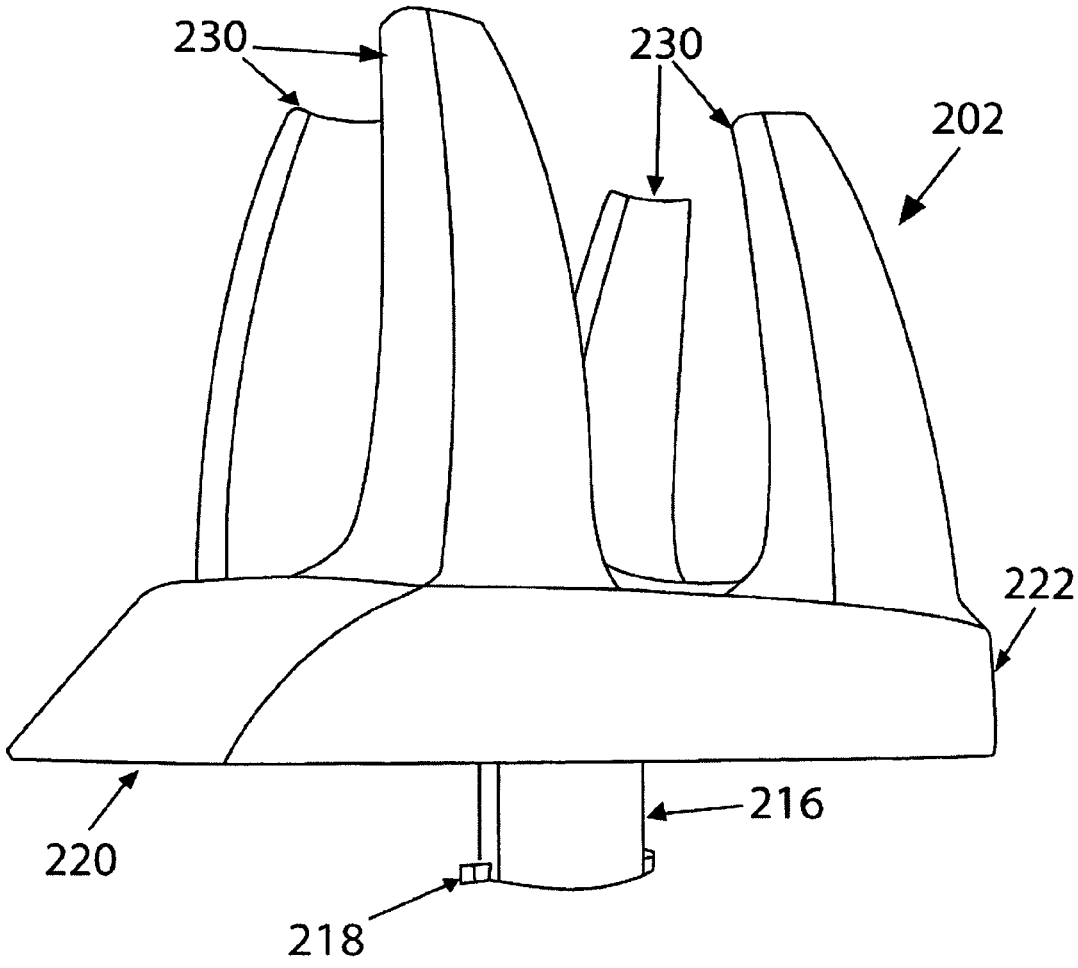
FIG. 29 is a front perspective view of the embodiment of FIG. 28.
Figure 30:
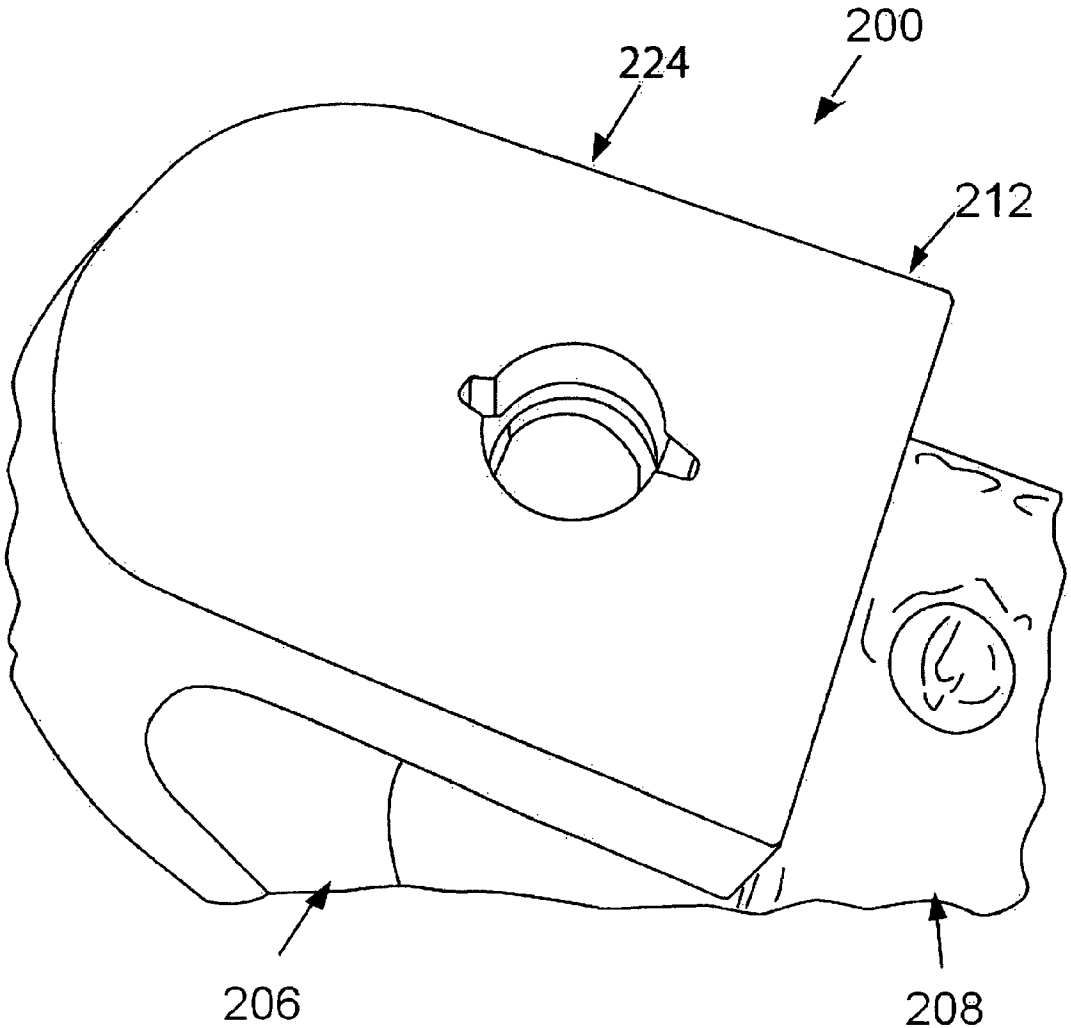
FIG. 30 is a top perspective view in partial cutaway of the support pedestal for the mounting structure to which the scanner assembly is removably secured.

With primary reference to FIGS. 28 through 30, various components of the detachment assembly 200, the mounting structure 202 and the supporting pedestal 212 of the detachment assembly 200 are shown in detail. As should be apparent from a review of the indicated Figures, the mounting structure 202 is readily detachable from the support pedestal 212 by virtue of a protruding finger or lug member 216. The lug member 216 includes a locking structure 218 protruding from the under surface 220 of the mounting structure base 222. With reference to FIG. 30, the support pedestal 212 includes an aperture or opening generally indicated as 224 having receiving grooves or recesses 226 for receipt therein of the locking member 218 of the protruding lug 216. A linear insertion and partial twisting or rotation of the protruding lug 216 will serve to removably secure the mounting structure 202 in the intended position as represented in FIGS. 24 through 26. As previously described the operative position of the mounting structure 202 is such as to accurately and precisely dispose the scanning or reading assembly 204 in its operative position. Such operative position may comprise the scanner 204 overlying the tag receiving portion 208 of the detachment assembly 200. As set forth above with regard to the previously described embodiments, the security tag assembly 10 is so positioned relative to the receiving portion 208 so as to accomplish authorized detachment or separation of the corresponding attachment members and bases.

With further reference to FIGS. 28 and 29, the mounting structure 202 includes a plurality of spaced apart upwardly extending mounting or gripping members 230. Each of the upwardly protruding and spaced apart gripping members or gripping fingers 230 are disposed in predetermined spaced relation to one another. Further the gripping members 230 are formed from a material having at least minimal inherent flexibility such that the handle or other portion 210 of the scanner assembly 204 can be forced therebetween into secured, mounting engagement therewith. However, the at least minimal inherent flexibility associated with each of the mounting fingers 230 is such as to allow a removal of the handle 210 and accordingly the scanner 204 by exerting an upwardly and/or outwardly pulling force thereon as should be apparent.

It is further emphasized that the specific dimension, configuration and number of the plurality of mounting fingers 230 may vary as well as the spacing therebetween and their specific disposition on the supporting pedestal 220. In a most preferred embodiment, the plurality of mounting members or fingers 230 are four in number and are structured and disposed so as to removably but securely grip the handle portion 210 of the scanner or reader assembly 204 in a manner which facilitates its accurate and secured placement in overlying relation to the security tag assembly 10 when the security tag assembly 10, mounting on the receiving portion 208 on the supporting base 206 of the detachment assembly 200 or its structural equivalent.

Figure 31A:
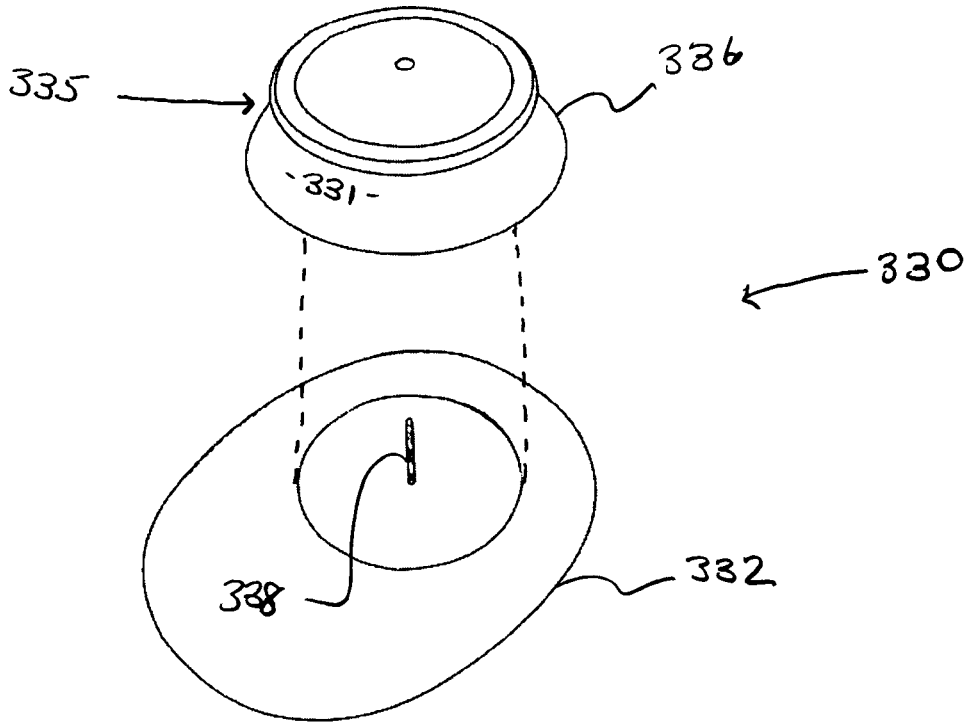
FIG. 31A is a partially exploded view of yet another embodiment of the security tag assembly disclosed herein.
Figure 31B:
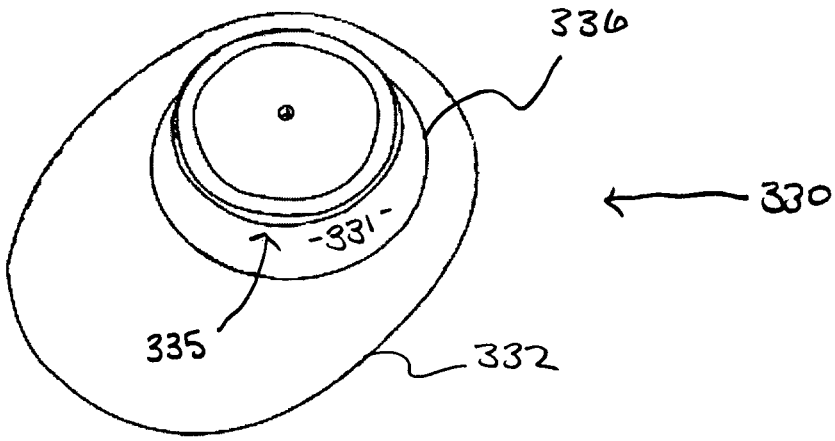
FIG. 31B is a perspective view of the security tag assembly illustrated in the partial exploded view of FIG. 31A.

With primary reference to FIGS. 31A and 31B, yet another embodiment of the security tag assembly of the present invention is generally indicated as 330. In particular, the security tag assembly 330 is at least operationally similar to the embodiments described above and as illustrated in FIGS. 1-30. Specifically, the security tag assembly 330 includes at least one base 332 and at least one attachment member 336, as illustrated in a partial exploded view of FIG. 31A. Moreover, the security tag assembly 330 includes a connector member 338 structured to interconnect the attachment member 332 and the attachment assembly 336 in an operative position, similar to the various embodiments described in detail above.

More in particular, and still referring to FIGS. 31A and 31B, the attachment member 336 of at least one embodiment of the present invention comprises at least one groove 335 disposed on a peripheral surface 331 of the attachment member 336, the significance of which will become apparent from the following discussion. In particular, the groove 335 may comprise at least one cut, indentation, and/or other similar structure formed at least partially, substantially, and/or completely on or around an exterior peripheral surface 331 of the attachment member 336.

As described in detail above, the present invention includes a detachment assembly 50, 50', 200 structured to detach the base 12, 132, 332 and the attachment member 14, 136, 335 out of the operative and/or interconnected position. In particular, and as described above, the detachment assembly 50, 50', 200 of at least one embodiment includes a detachment structure 82, such as, for example, a drive shaft 52, 52', which is structured to at least partially separate the base 12, 132, 332 from the attachment member 14, 136, 335 via disposition of the detachment structure 82 in an at least partially forced engagement with the connector member 338.

Figure 32A:
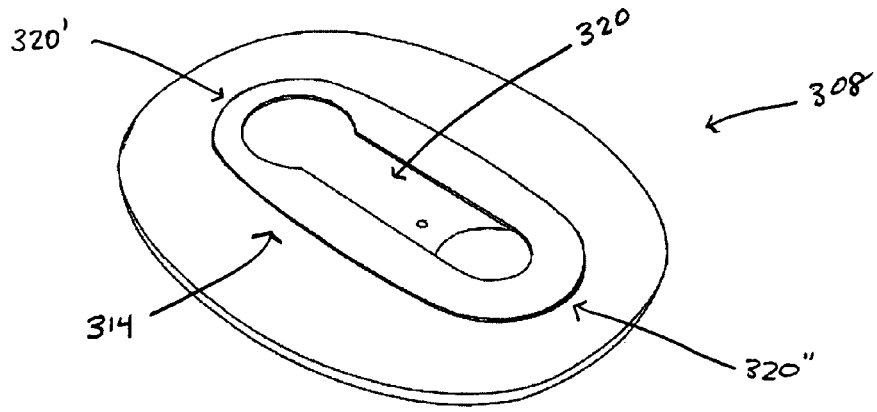
FIGS. 32A and 32B illustrate a perspective and partially exploded view, respectively, of at least one embodiment of the holding and/or stabilizing assembly of the detachment assembly of the present invention.

Moreover, in at least one embodiment, the present invention includes a receiving structure 308 (illustrated in FIGS. 32A and 32B) which is cooperatively structured to be disposed in an operative orientation relative to a detachment assembly 200 or its structural equivalent, as disclosed herein. The receiving structure 308 is similar in function and structure to the receiving area 208 illustrated in FIG. 27. In particular, the receiving structure 308 may be structurally integrated with, or removably disposable relative to the detachment assembly 50, 50', 200. More in particular, referring to FIGS. 32A and 32B, the receiving structure 308 of at least one embodiment comprises a holding assembly 314 structured to at least partially engage at least a portion of the attachment member 14, 136, 336 of the security tag assembly 10, 130, 330.

Figure 32B:
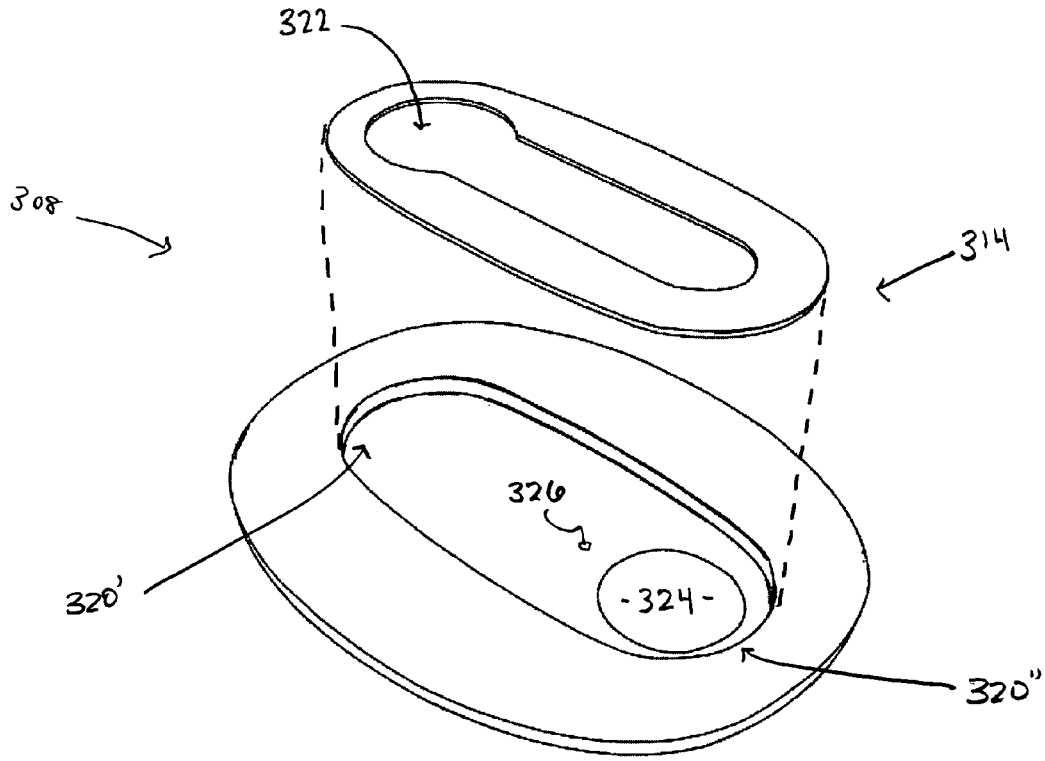

Additionally, in at least one embodiment of the present invention, the holding assembly 314 is structured to define a receiving channel 320 cooperatively structured and disposed such that the attachment member 14, 136 336 is disposable in a slidable relation therewith. As illustrated in FIG. 32B, the holding assembly 314 and/or the receiving channel 320 includes an entry aperture 322 and an exit aperture 324 disposed in a spaced relation from one another along a length of the receiving channel 320. Moreover, the holding assembly 314 and/or receiving channel 320 of at least one embodiment includes a first end 320' and a second end 320" wherein the entry aperture 322 is disposed proximate the first end 320', and the exit aperture 324 is disposed proximate the second end 320".

Either way, the entry aperture 322 is structured and configured to facilitate and/or allow disposition of at least a portion of the attachment member 336 therethrough and into a slidable relation within the receiving channel 320. More in particular, and as will be described in greater detail below, the exit aperture 324 is structured and configured to facilitate and/or allow disposition of the attachment member 336 therethrough and out of a slidable relation with the receiving channel 320. Furthermore, the receiving structure 308 and/or holding assembly 314 further includes a detachment aperture 326, which in at least one embodiment is disposed in a receiving relation with the detachment structure 82 and between the entry aperture 322 and the exit aperture 324 along a length of the receiving channel 320. For instance, as will become apparent from the following discussion, the attachment member 336 and/or the connector member 338 of the security tag assembly 330 are disposable in an aligned relation with the detachment aperture 326 to facilitate the detachment of the attachment member 336 from the base 332, as disclosed herein. In particular the detachment aperture 326 is cooperatively structured and configured to receive the detachment structure 82 therethrough in a manner to allow the detachment structure 82 to be disposed in an engaging relation with the security tag assembly 330.

Figure 33A:
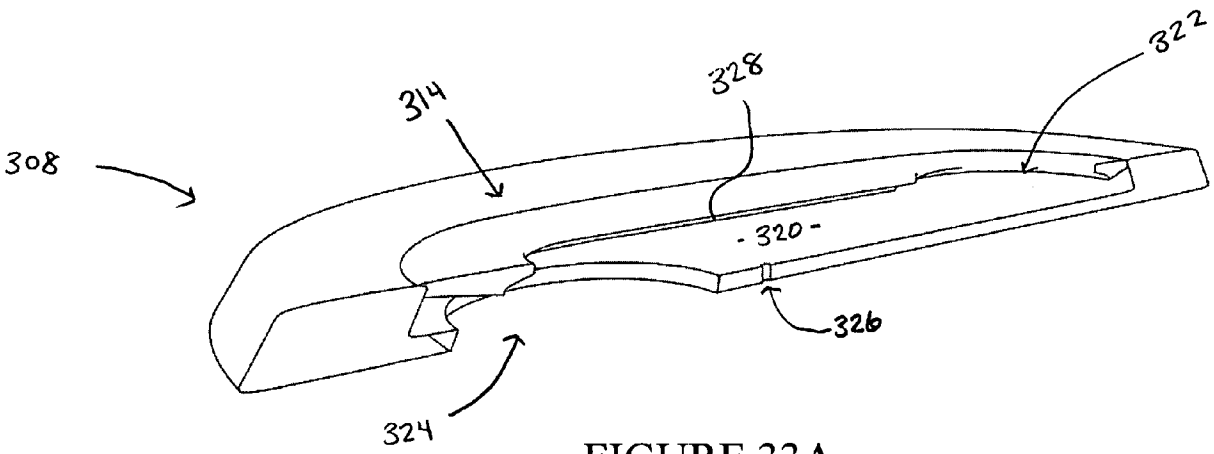
FIGS. 33A through 33G are partial cut-away views of the holding and/or stabilizing assembly illustrated in FIGS. 32A and 32B.
Figure 33B:
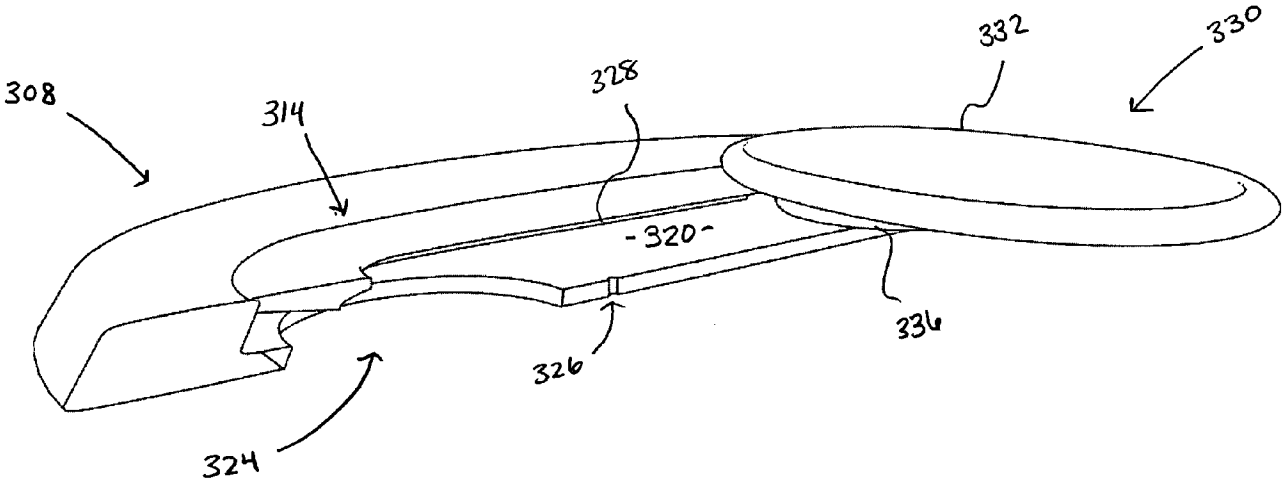
Figure 33C:
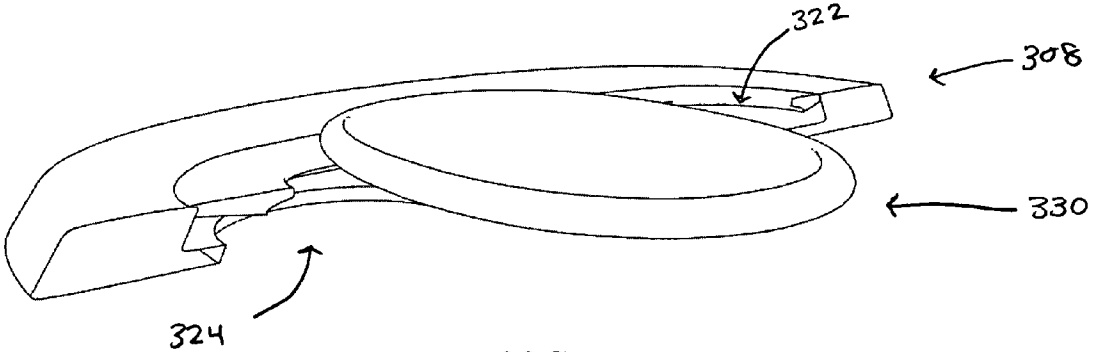
Figure 33D:
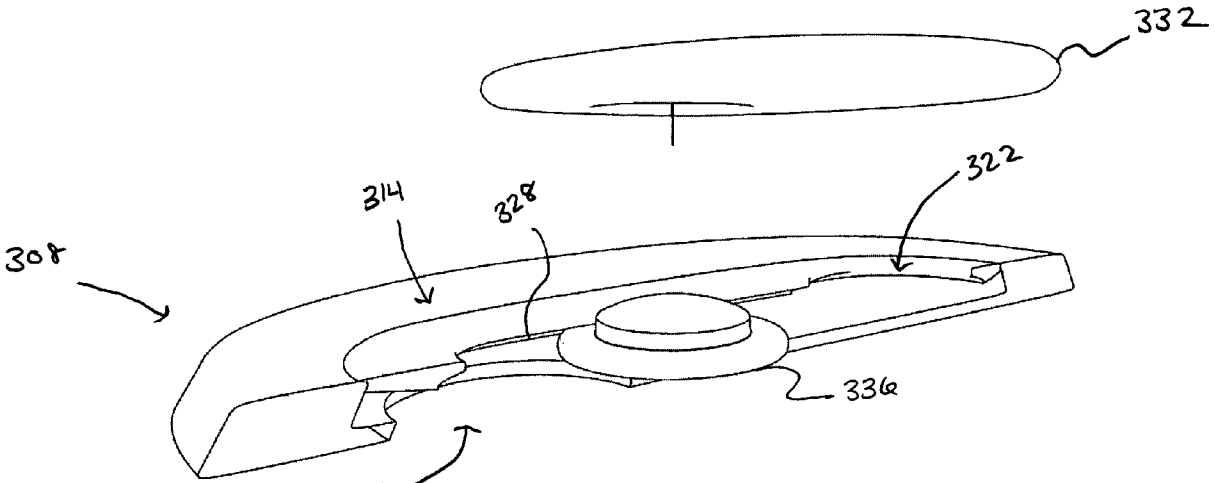

For exemplary purposes, FIGS. 33A through 33G illustrate the structures, functionality, and operability of the holding assembly 314 of at least one embodiment of the present invention via partial cut-away illustrations. For instance, FIG. 33B illustrates a partial cut-away view of the receiving structure 308 and/or holding assembly 314 wherein a security tag assembly 330, and in particular an attachment member 336 thereof, is disposed in a slidable relation within the receiving channel 320. Furthermore, once the security tag assembly 330 is inserted within the entry aperture 322, the security tag assembly 330 may slide or otherwise be disposed within the receiving channel 320 and along a length thereof between the spaced apart entry and exit apertures 322, 324, respectively, as illustrated in FIG. 33C.

Upon disposing the security tag assembly 330 in an aligned relation or operative position relative to the detachment aperture 326 and/or detachment structure 82 (not illustrated in FIGS. 33A through 33G), the detachment structure 82 may be disposed in a forced engagement with the security tag assembly 330, and in particular, the connector member 338 thereof, so as to detach the attachment member 336 from the base 332. Particularly, the holding assembly 314 is structured to secure the attachment member 336 to the detachment assembly, at least while the detachment structure 82 is disposed in a forced engagement with the security tag assembly 330. For instance, at least one embodiment of the holding assembly 314 of the present invention includes at least one ledge 328 structured to at least partially define the receiving channel 320. The ledge 328, which may be disposed along a length of the receiving channel 320 and/or between the entry and exit apertures 322, 324, respectively, is structured and configured to secure the security tag assembly, and in particular, the attachment member 336 thereof, to the detachment assembly and/or holding assembly 314 at least during the forced engagement between the detachment structure 82 and the connector member 338. For example, the ledge 328 of the detachment assembly and the groove 335 of the attachment member 336 of at least one embodiment of the present invention are cooperatively structured and disposable in an engaging relation with one another so as to facilitate the practice of the present invention in the intended manner. Moreover, the ledge 328 of the detachment assembly and the groove 335 of the attachment member 336 may be cooperatively structured to facilitate the slidable relation of the security tag assembly 330 within the receiving channel 320.

Figure 33E:
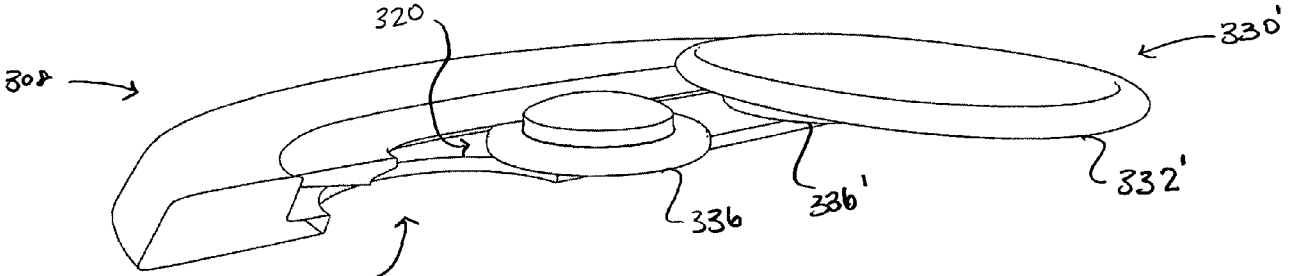
Figure 33F:
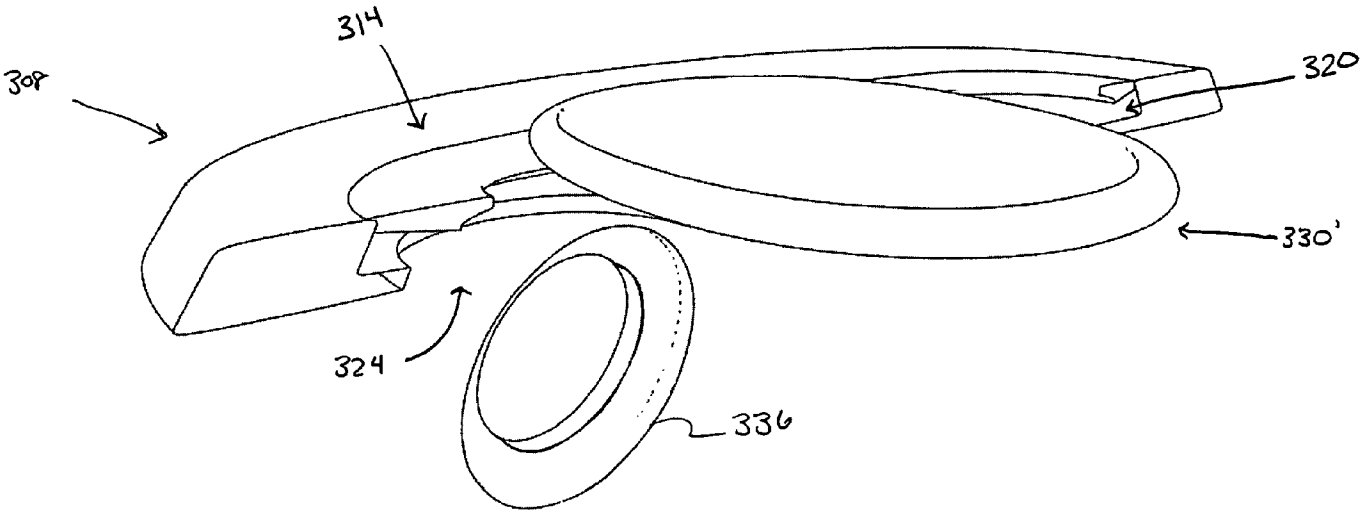

As illustrated in FIG. 33E, in at least one embodiment of the present invention, once the attachment member 336 is detachably disposed from the base 332 (not illustrated), the attachment member 336 may remain within the receiving channel 320 and in a slidable engagement therewith. As such, upon disposition of another security tag assembly 330' in slidable relation within the receiving channel 320, and in particular upon disposition of another or second attachment member 336' in an abutting engagement with the detachably disposed attachment member 336 within the receiving channel 320, the detachably disposed attachment member 336 is slidably forced out of the receiving channel 320 via the exit aperture 324, as illustrated in FIGS. 33E and 33F.

Figure 33G:
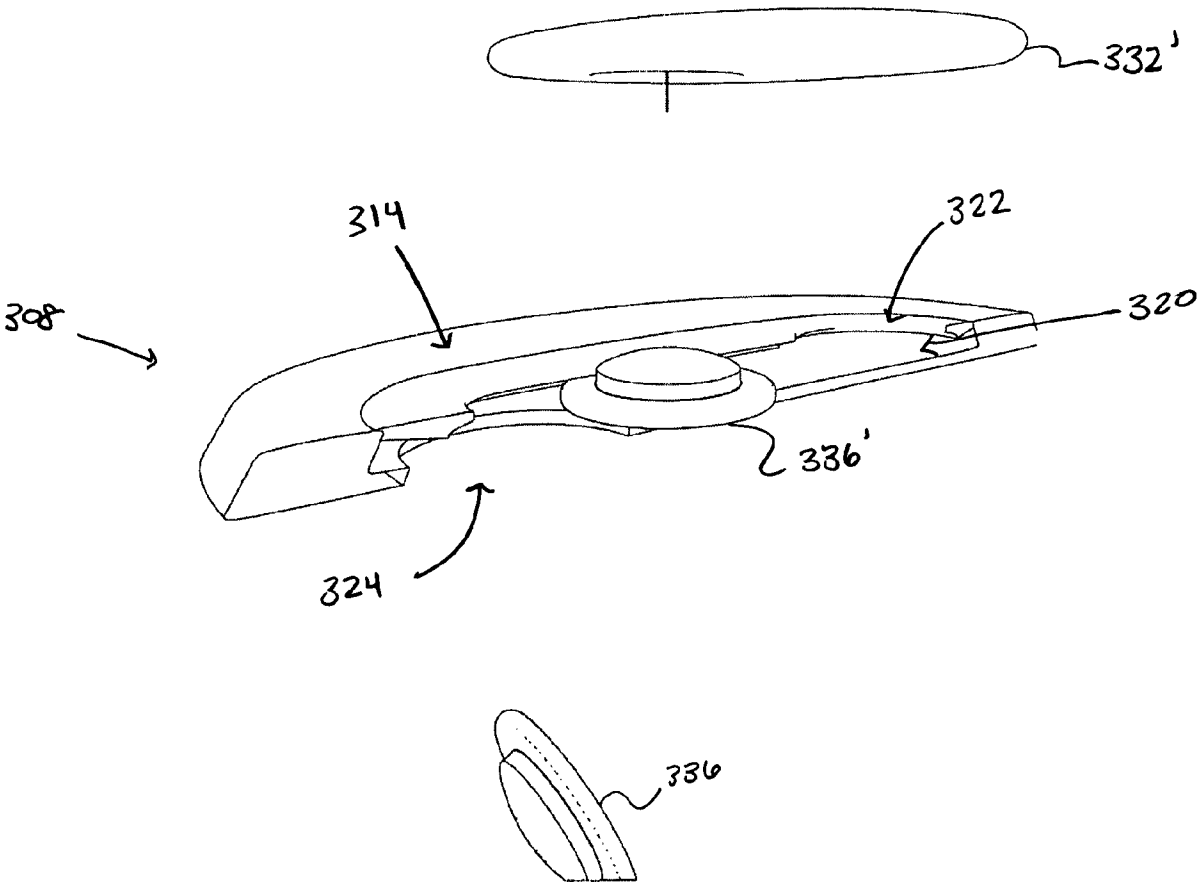

As should be apparent, and as illustrated in FIG. 33G, the other or second security tag assembly 330' may then be disposed in an operative relation relative to the detachment structure 82 (not illustrated) such that the second attachment member 336' is detachably disposed from the base 332' in the manner described in detail above.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A security system for discouraging unauthorized removal of merchandise from a given area, said security system comprising:

a security tag assembly comprising at least one attachment member and at least one base, said attachment member and said base being connectable in an operative position relative to the merchandise, said security tag assembly further comprising a connector member structured to interconnect said attachment member and said base in said operative position, wherein said security tag assembly further comprises a locking assembly; said locking assembly comprising a locking member mounted within said attachment member, a detachment assembly disposable in a removably engaging relation with said security tag assembly and structured to detach said base and said attachment member out of said operative position, said detachment assembly comprising least one detachment structure disposable in an at least partially forced engagement with said connector member of said security tag assembly, said at least one detachment structure being structured to at least partially separate said base from said attachment member via disposition of said detachment structure in said at least partially forced engagement with said connector member of said security tag assembly, said detachment structure being disposable in a forced engagement with said locking member and being structured to destructively remove said attachment member from said base, said detachment structure comprising a drive shaft having an at least partially hollow interior configuration disposed adjacent a free, open end of said drive shaft, and said at least partially hollow interior configuration of said drive shaft being dimensioned and configured to assume a covering relation to at least a portion of said connector member of said security tag assembly.

2. A security system for discouraging unauthorized removal of merchandise from a given area, said security system comprising:

a security tag assembly comprising at least one attachment member and at least one base, said attachment member and said base being connectable in an operative position relative to the merchandise, said security tag assembly further comprising a connector member secured to said base and structured to interconnect said attachment member and said base in said operative position, a detachment assembly removably connectable to said security tag assembly and structured to detach said base and said attachment member out of said operative position, said detachment assembly comprising at least one detachment structure disposable in an at least partially forced engagement with said connector member of said security tag assembly, said at least one detachment structure being structured to at least partially separate said base from said attachment member via disposition of said detachment structure in said at least partially forced engagement with said connector member of said security tag assembly, said detachment structure of said detachment assembly is structured to destructively remove said attachment member from said base, said detachment assembly further comprising a holding assembly structured to at least partially engage at least a portion of said attachment member and secure said attachment member to said detachment assembly, said holding assembly being structured to define a receiving channel, wherein said attachment member of said security tag assembly is removably disposable in a slidable relation with said receiving channel, said detachment structure comprising a drive shaft; said drive shaft comprising an at least partially hollow interior configuration disposed adjacent a free, open end thereof, and said at least partially hollow interior configuration of said drive shaft being dimensioned and configured to assume a covering relation to at least a portion of said connector member of said security tag assembly.

3. A security system for discouraging unauthorized removal of merchandise from a given area, said security system comprising:

a security tag assembly comprising at least one attachment member and at least one base, said attachment member and said base being connectable in an operative position relative to the merchandise, said security tag assembly further comprising a connector member structured to interconnect said attachment member and said base in said operative position, wherein said security tag assembly further comprises a locking assembly; said locking assembly comprising a locking member mounted within said attachment member, a detachment assembly disposable in a removably engaging relation with said security tag assembly and structured to detach said base and said attachment member out of said operative position, said detachment assembly comprising at least one detachment structure disposable in an at least partially forced engagement with said connector member of said security tag assembly, said at least one detachment structure being structured to at least partially separate said base from said attachment member via disposition of said detachment structure in said at least partially forced engagement with said connector member of said security tag assembly, said detachment assembly further comprising a receiving structure structured to receive said security tag assembly in an operative orientation therewith, said receiving structure comprising a holding assembly structured to at least partially engage at least a portion of sated attachment member of said security tag assembly, said holding assembly being further structured to secure said attachment member to said detachment assembly at least while said detachment structure is disposed in said at least partially forced engagement with connector member of said security tag assembly, said holding assembly comprising a receiving channel and said attachment member being disposable in a slidable relation within said receiving channel, said holding assembly further comprising an entry aperture and an exit aperture disposed in a spaced relation from one another along a length of said receiving channel, and said entry aperture being structured and configured to dispose said attachment member of said security tag assembly therethrough and into said slidable relation within said receiving channel; said exit aperture being structured and configured to dispose said attachment member therethrough and out of said slidable relation within said receiving channel.

4. The security system recited in claim 3 wherein said detachment structure of said detachment assembly is disposable within said receiving channel and into said at least partially forced engagement with said connector member of said security tag assembly between said entry aperture and said exit aperture.

5. The security system recited in claim 4 further comprising a detachment aperture disposed within said receiving channel in a receiving relation with said detachment structure.

6. The security system recited in claim 5 wherein said connector member of said security tag assembly is disposable in an aligned relation with said detachment aperture.

7. The security system recited in claim 6 wherein said detachment aperture is disposed along said length of said receiving channel and between said entry aperture and said exit aperture.

* * * * *